US011840421B2

(12) United States Patent
Fontaine et al.

(10) Patent No.: US 11,840,421 B2
(45) **Date of Patent: *Dec. 12, 2023**

(54) TELESCOPING CABLE SPOOL

(71) Applicant: BELDEN CANADA ULC, Saint-Laurent (CA)

(72) Inventors: Marc Fontaine, Les Cèdres (CA); Michael Singleton, Montréal (CA)

(73) Assignee: BELDEN CANADA ULC, St. Laurent (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/807,312

(22) Filed: Jun. 16, 2022

(65) Prior Publication Data

US 2022/0306423 A1 Sep. 29, 2022

Related U.S. Application Data

(63) Continuation of application No. 16/539,395, filed on Aug. 13, 2019, now Pat. No. 11,370,636.

(60) Provisional application No. 62/718,117, filed on Aug. 13, 2018.

(51) Int. Cl.
*B65H 75/14* (2006.01)
*B65H 75/24* (2006.01)

(52) U.S. Cl.
CPC ..... *B65H 75/2416* (2021.05); *B65H 75/14* (2013.01); *B65H 2402/54* (2013.01); *B65H 2701/32* (2013.01)

(58) Field of Classification Search
CPC .. B65H 75/14; B65H 75/241; B65H 2402/54; B65H 2701/32
See application file for complete search history.

(56) References Cited

U.S. PATENT DOCUMENTS

| | | | | |
|---|---|---|---|---|
| 3,036,785 | A | 5/1962 | Rossi | |
| 3,208,690 | A | 9/1965 | Mire | |
| 5,467,938 | A * | 11/1995 | Redman | B65H 75/2416 242/615.3 |
| 7,627,223 | B1 | 12/2009 | Burek et al. | |
| 7,627,233 | B2 | 12/2009 | Burek et al. | |
| 11,370,636 | B2 * | 6/2022 | Fontaine | B65H 75/241 |
| 2015/0177473 | A1 | 6/2015 | Smith et al. | |

* cited by examiner

*Primary Examiner* — Sang K Kim
(74) *Attorney, Agent, or Firm* — Lavery, de Billy, LLP; Hugh Mansfield

(57) ABSTRACT

A telescoping cable spool for attaching to a networking equipment and supporting a plurality of fiber optic cables is shown. The spool comprises a fixed part for attachment to a surface adjacent the networking equipment; a spool housing comprising a pair of cable retaining flanges interconnected by a hollow cable support dimensioned to fit in a telescoping arrangement over the fixed part. The spool housing is moveable relative to the fixed part between a first retracted position and a second extended position.

18 Claims, 25 Drawing Sheets

TELESCOPING CABLE SPOOL

CROSS REFERENCE TO RELATED APPLICATIONS

This application is a continuation of U.S. application Ser. No. 16/539,395 filed on Aug. 13, 2019 which claims benefit of U.S. provisional application Ser. No. 62/718,117 filed on Aug. 13, 2018. All documents above are incorporated herein in its entirety by reference.

FIELD OF THE INVENTION

The present invention relates to a telescoping cable spool. In particular, the present invention relates to a cable spool which is moveable between a retracted position and an extended position and comprises a mechanism for securing the cable spool in the retracted position and the extended position.

BACKGROUND TO THE INVENTION

To meet the demands of increasing density, fiber optic networking equipment such as cross connects have provided more or more ports for terminating more and more fiber optic cables. As the cables need to be periodically reconfigured or changed, the cables are typically loosely draped over a plurality of cable spools which are secured array-like in rows and columns to the racks adjacent the networking equipment or cross connect equipment and such that the cables can be readily accessed. One drawback of these existing designs is that with the increase in density and the number of cables being managed on a given array of cable spools, accessing and rerouting, removing or adding individual cables is difficult.

SUMMARY OF THE INVENTION

In order to address the above and other drawbacks there is provided a cable spool for attaching to a networking equipment and supporting a plurality of fiber optic cables. The spool comprises an elongate rail for mounting horizontally to the network equipment, a spool comprising a base slideably mounted to the elongate rail, an outer end comprising a cable retaining flange and an elongate cylindrical cable support interconnecting the base and the outer end, and a rail locking mechanism for securing the base to the elongate rail in one of at least two horizontal positions, the base further comprising a release button for releasing the rail locking mechanism such that the spool can be moved between the at least two horizontal positions.

There is also provided a telescoping cable spool for attaching to a networking equipment and supporting a plurality of fiber optic cables. The spool comprises an elongate cylindrical fixed part for attachment to a surface adjacent the networking equipment, a spool housing comprising a pair of cable retaining flanges interconnected by a hollow elongate cylindrical cable support dimensioned to fit in a telescoping arrangement over the elongate cylindrical fixed part, the spool housing moveable relative to the fixed part between a first retracted position and a second extended position, a locking mechanism for releasably retaining the spool housing in the first retracted position, and an actuator for releasing the locking mechanism.

Additionally, there is provided a telescoping cable spool for attaching to a networking equipment and supporting a plurality of fiber optic cables. The spool comprises an elongate hollow cylindrical fixed part comprising a base for attachment to a surface adjacent the networking equipment, the fixed part comprising a first elongate slot along a length thereof, an elongate actuation member dimensioned to fit slideably within the elongate cylindrical fixed part and comprising a guide pin extending laterally and engaged in the first elongate slot for sliding therein between a rearward position and a forward position, and a spool housing comprising a pair of cable retaining flanges interconnected by a hollow elongate cylindrical cable support dimensioned to fit in a telescoping arrangement over the elongate cylindrical fixed part, an inner surface of the spool housing comprising a first recess intersecting the first elongate slot and engaging an end of the guide pin. The guide pin links the spool housing to the elongate actuation member such that the spool housing, the elongate actuation member and the guide pin are moveable together relative to the fixed part and along the slot between a first retracted position and a second extended position.

Furthermore, there is provided a cable spool for attaching to a networking equipment and supporting a plurality of fiber optic cables. The spool comprises a static spool comprising an inner end secured to the networking equipment, an outer end comprising a cable retaining flange and a first elongate cylindrical cable support interconnecting the inner end and the outer end, and an extendable spool comprising an inner cable retaining flange and an outer cable retaining flange interconnected by a second elongate cylindrical cable support. The first elongate cylindrical cable support and the second elongate cylindrical cable support are arranged about a spool axis and wherein the second extendable spool is moveably secured to the outer end about the spool axis for movement between a retracted position, wherein the inner cable retaining flange is positioned immediately adjacent the outer end, and an extended position, wherein the inner cable retaining flange is away from the outer end.

BRIEF DESCRIPTION OF THE DRAWINGS

FIG. 9C provides a third detail cutaway view of the telescoping cable spool of FIG. 8A in an extended position;

DETAILED DESCRIPTION OF THE ILLUSTRATIVE EMBODIMENTS

Figure 1:
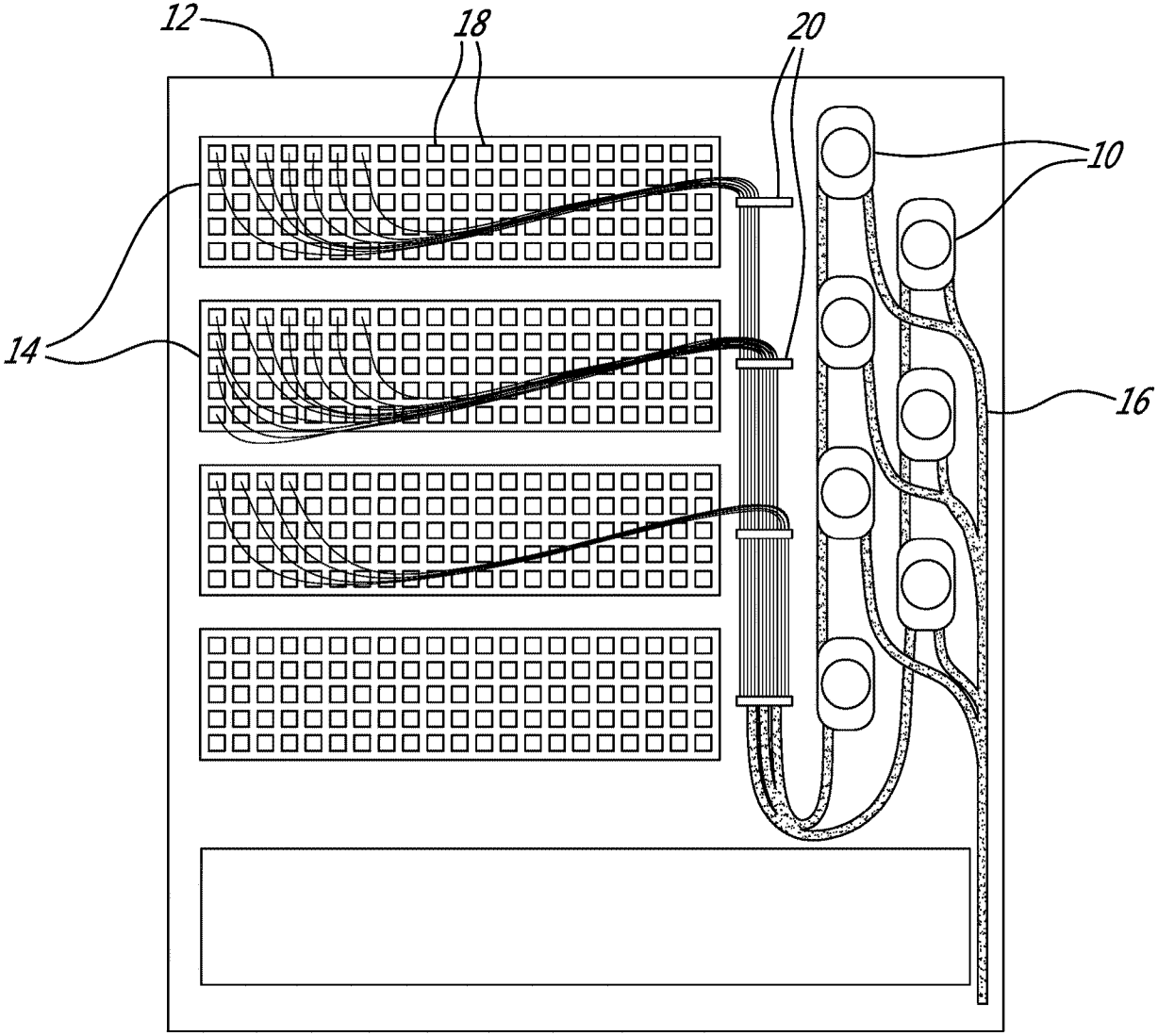
FIG. 1 provides a front plan view of a cross connect system comprising a plurality of the telescoping cable spools in accordance with an illustrative embodiment of the present invention.

Referring now to FIG. 1, a telescoping cable spool, generally referred to using the reference numeral 10, will be described. The spool 10 is foreseen for use together with a plurality of like spools 10 for example in a cross connect cabinet 12 comprising network equipment 14 and is used to support a plurality, or bundle, of fiber optic cables 16 for example terminated at one end at a respective port 18 of a respective piece of networking equipment 14. The bundles of optic fibers 16 may be arranged in cable guides 20 and are shown as being looped over one or more of the spools 10 prior to the cables 14 exiting the cross connect cabinet 12, for example for termination at networking equipment in another cross connect cabinet (both not shown).

Figure 2:
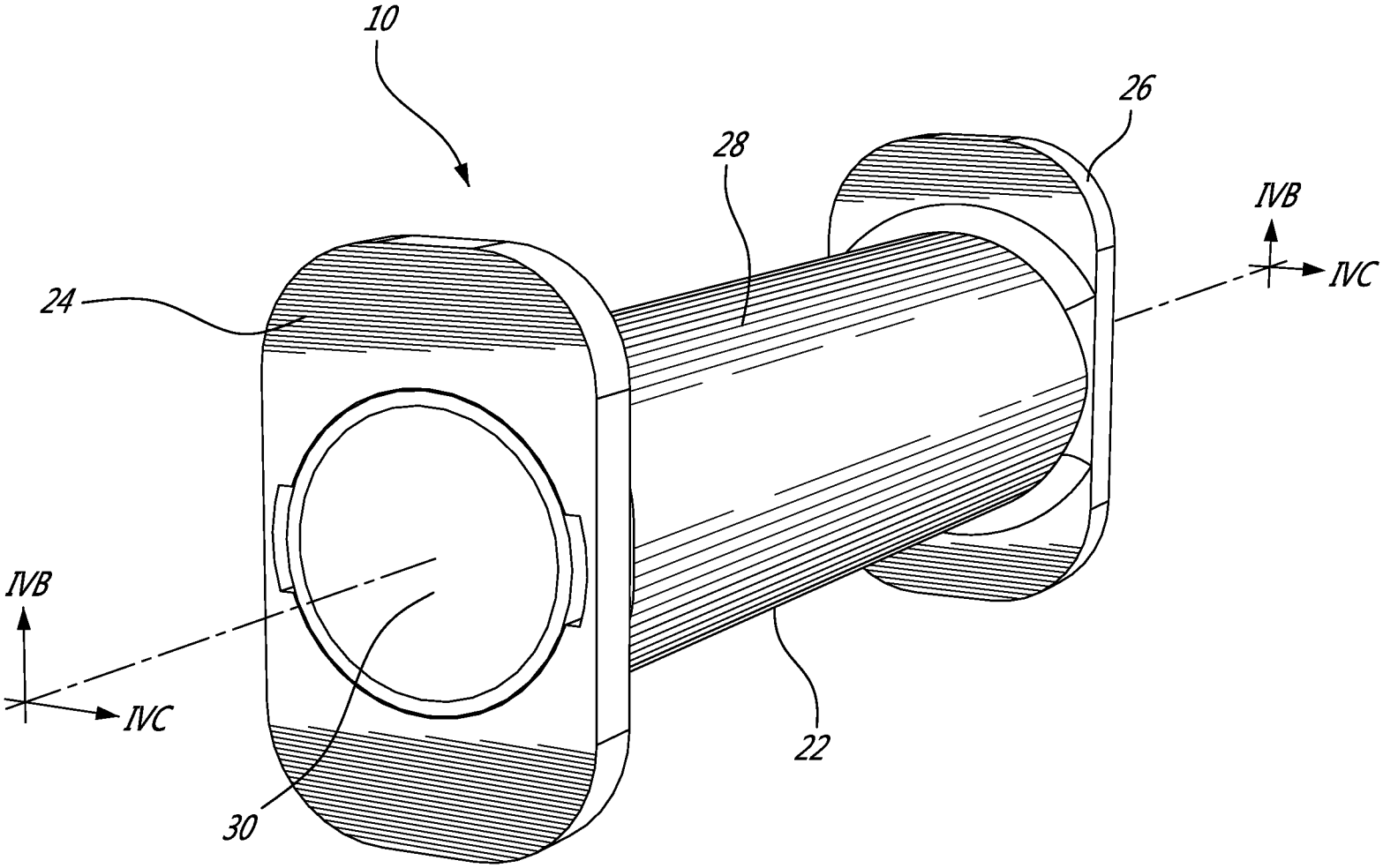
FIG. 2 provides a raised right perspective view of a telescoping cable spool in accordance with an illustrative embodiment of the present invention.

Referring now to FIG. 2, each spool 10 comprises a hollow outer housing 22 moulded from a rigid material such as plastic or the like and comprising a pair of cable retaining flanges 24, 26 separated by a cylindrical cable support 28. As will be discussed in more detail below, a push button actuator 30 is also provided.

Figure 3:
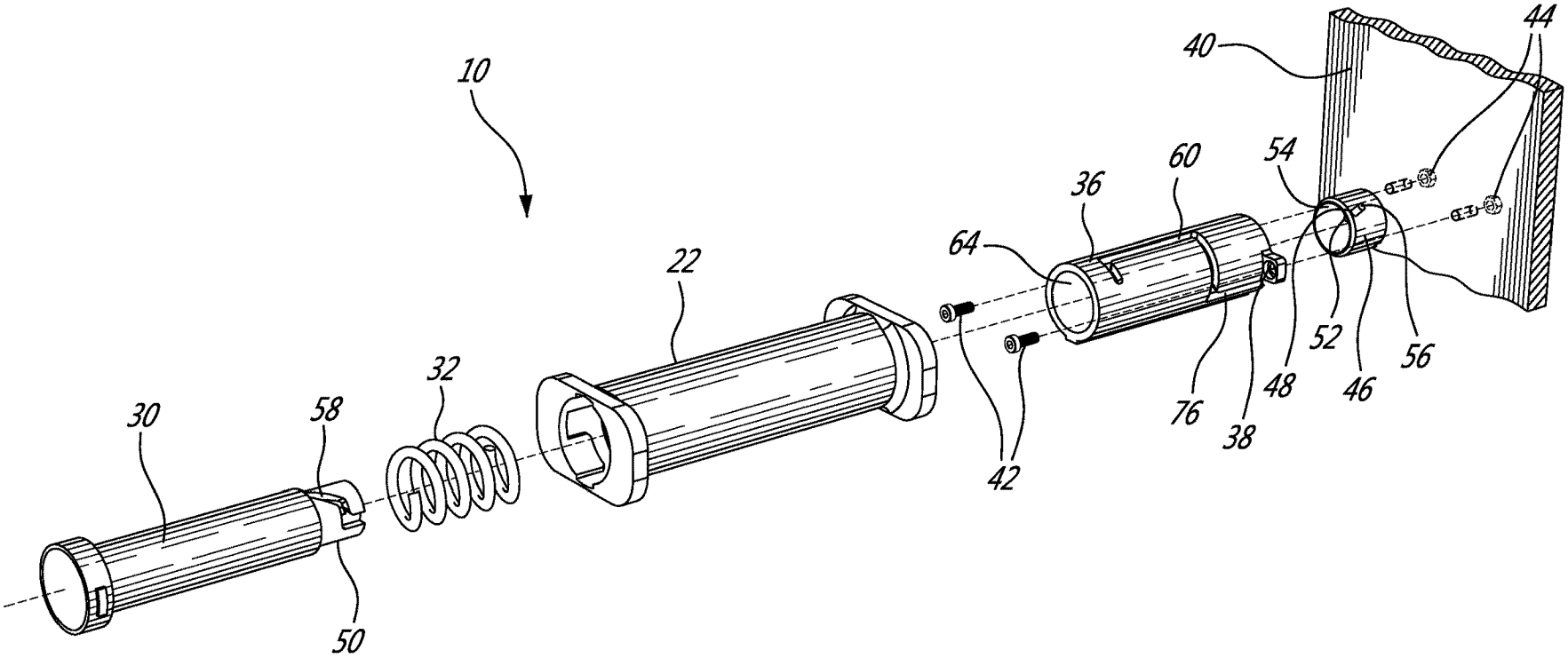
FIG. 3 provides an exploded view of a telescoping cable spool in accordance with an illustrative embodiment of the present invention.

Referring not to FIG. 3 in addition to FIG. 2, in addition to the hollow outer housing 22 and the push button actuator 30 the spool 10 further comprises a coil spring 32 mounted over the outer surface 34 of the push button actuator 30 and a hollow elongate cylindrical fixed part 36 comprising a pair of opposed attachment flanges 38 via which the fixed part 36 can be attached to a surface 40, for example using a pair of bolt 42 and nut 44 assemblies. The fixed part 36 is dimensioned to fit snugly within the cylindrical cable support 28 and to snugly receive the push button actuator 30. A collar 46 is also provided comprising a guide pin 48 which is dimensioned to fit within the fixed part 36 while encircling a narrow end 50 of the push button actuator 30. The guide pin 48 is arranged a right angles to an axis as defined by the collar 46 and such that a first end 52 of the guide pin 48 penetrates into the space 54 defined by the collar 46 and a second end 56 of the guide pin 48 extends outwards away from the collar 46. When assembled, the first end 52 engages a first channel 58 in the narrow end 50 of the push button actuator 30 and the second end 56 engages inter alia a second channel 60 in the fixed part 36.

Figure 4A:
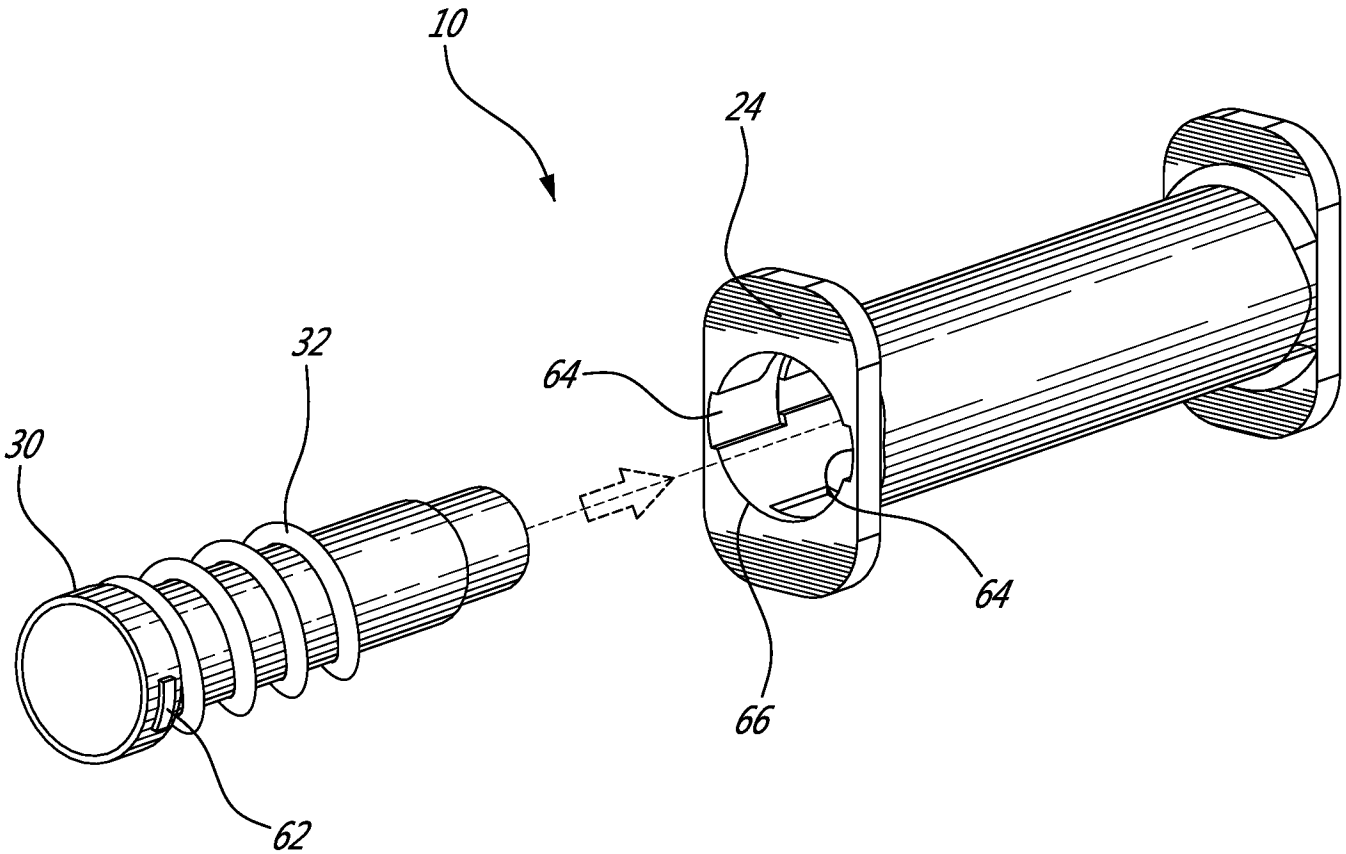
FIG. 4A provides a raised right perspective view detailing the assembly of a telescoping cable spool in accordance with an illustrative embodiment of the present invention.

Referring now to FIG. 4A in addition to FIG. 3, in order to assemble the spool 10 prior to installation of the spool 10 onto a surface 40, the spring 32 is placed over the push button actuator 30 which is then rotated such that a pair of stops 62 align with respective ones of a pair of "J" shaped guide channel openings 64. Alternatively the spring 32 can simply be inserted into the opening 66 in the retaining cable flange 24.

Figure 4B:
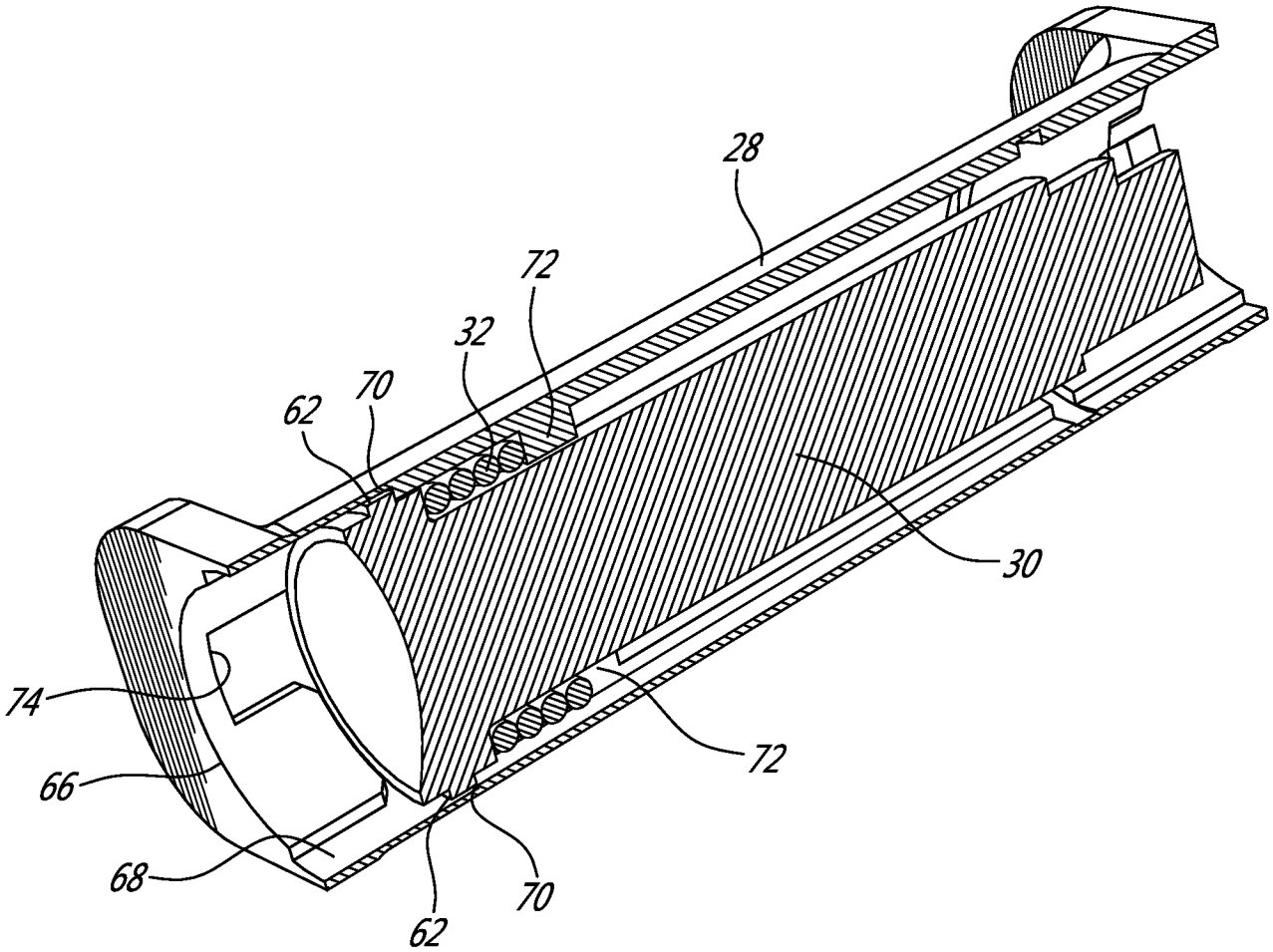
FIG. 4B provides a sectional view detailing the assembly of a telescoping cable spool along line IVB-IVB in FIG. 2.
Figure 4C:
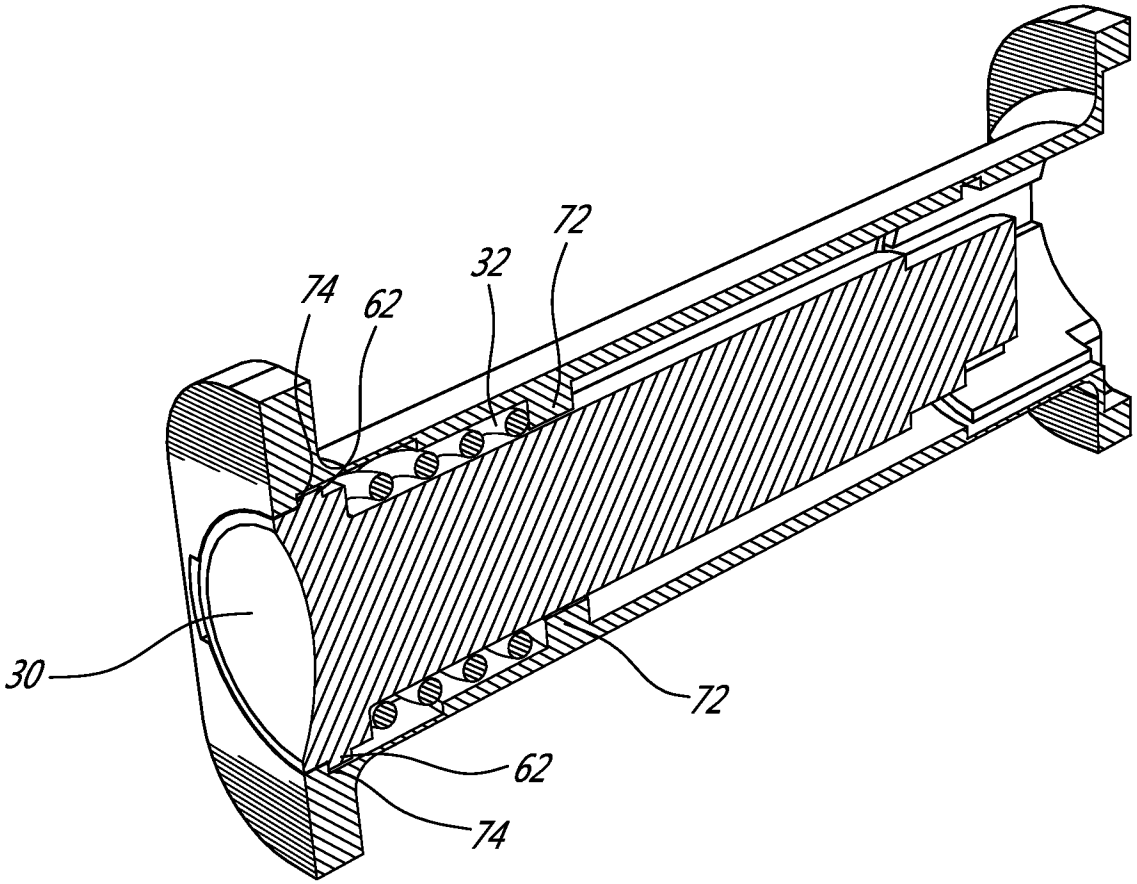
FIG. 4C provides a sectional view detailing the assembly of a telescoping cable spool along line IVC-IVC in FIG. 2.

Referring now to FIG. 4B, the push button actuator 30 is then inserted into the opening 66 against the bias of the spring 32 such that the stops 62 are guided by respective ones of the guide channel 68 and until the stops 62 butt against respective edges 70 of the guide channels 68. At this point the spring 32 is compressed between the actuator 30 and an annular partial collar 72 which is positioned within the cylindrical cable support 28. Referring now to FIG. 4C in addition to FIG. 4B, the actuator 30 is rotated 90 degrees clockwise and until the stops 62 are aligned with respective ends 74 of the guide channels 68 and then released. The spring 32 biases the actuator 30 axially away from the annular partial collar 72 and such that the stops 62 rest against their respective ends 74 of the guide channels 68.

Figure 4D:
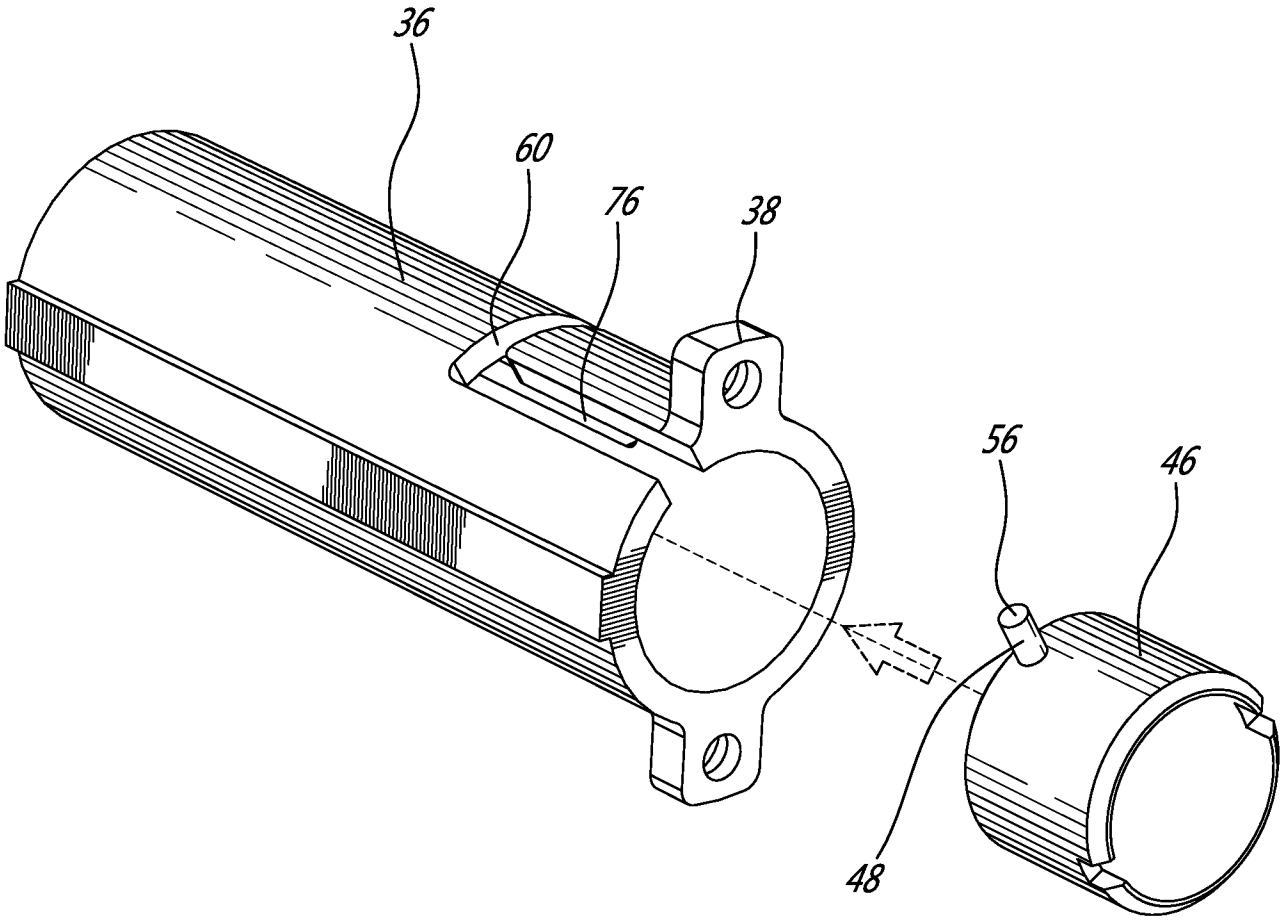
FIG. 4D provides a raised left rear exploded view detailing the assembly of a fixed part and a collar of a telescoping cable spool in accordance with an illustrative embodiment of the present invention.
Figure 4E:
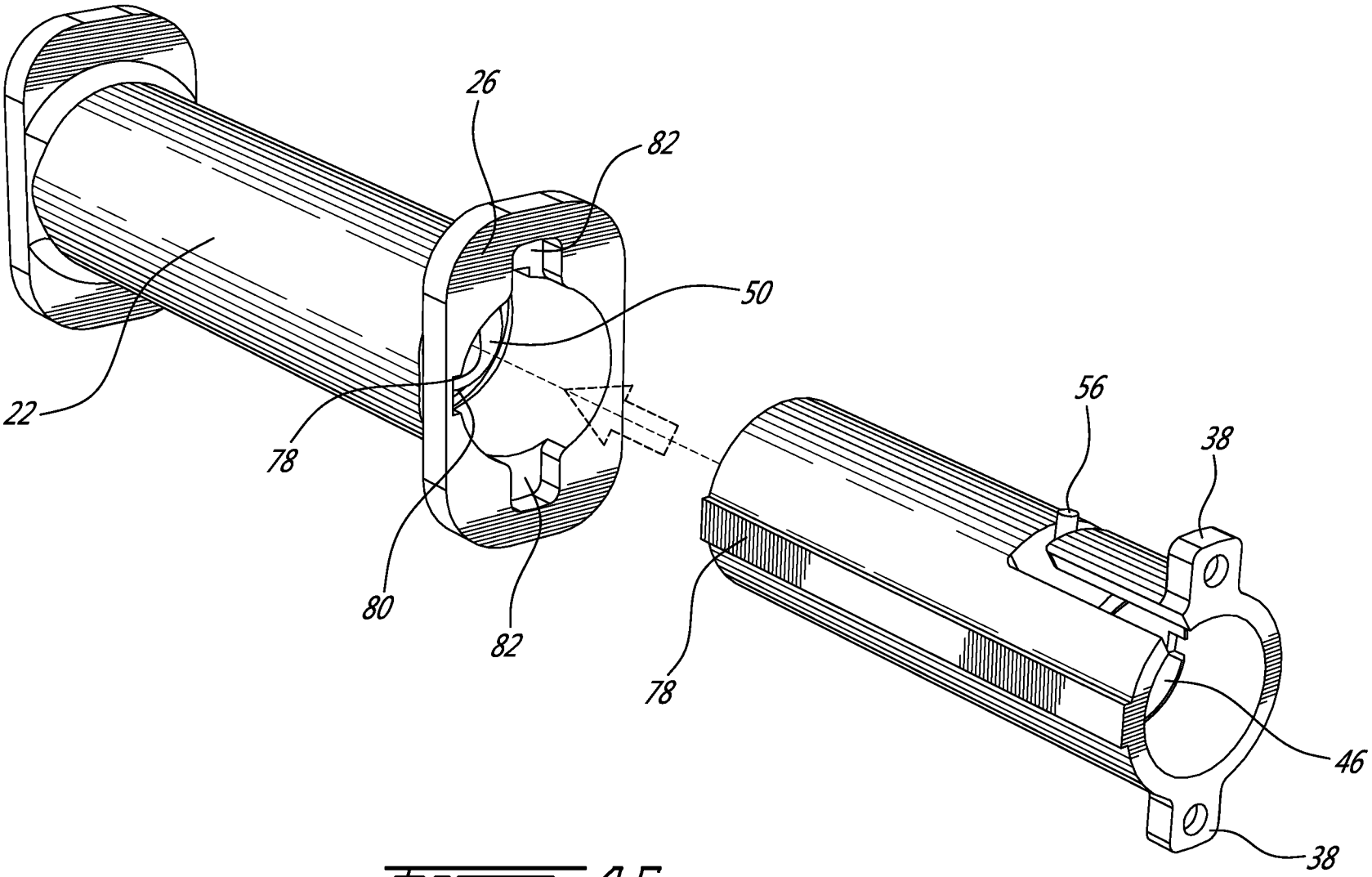
FIG. 4E provides a raised left rear exploded view detailing the assembly of a telescoping cable spool in accordance with an illustrative embodiment of the present invention.

Referring now to FIG. 4D, the collar 46 is then assembled to the fixed part 36 by aligning the first end 52 of the guide pin 48 with an entrance 76 to the second channel 60, sliding the collar into the fixed part 36 then rotating the collar 46 about 30 degrees clockwise until the guide pin 48 is aligned with one of the flanges 38, as shown in FIG. 4E.

Still referring to FIG. 4E, the fixed part 36/collar 46 assembly is assembled to the cylindrical cable support 28/actuator 30 assembly by aligning a rail 78 with a channel 80 on the inner surface of the cylindrical cable support 28 and then inserting the fixed part 36/collar 46 assembly into the housing 22 via an opening an opening 82 in the flange 26 until the attachment flanges 38 are received within corresponding attachment flange receiving cut outs 84 in the flange 26, the collar 42 encircles the narrow end 50 of the actuator 30, and the first end 52 of the guide pin 48 is received within the first channel 58 in the narrow end 50 of the push button actuator 30. At this point the second end 54 of the guide pin 48 is engaged within the second channel 60 in the fixed part 36 as well as an annular groove (not shown)

Figure 4F:
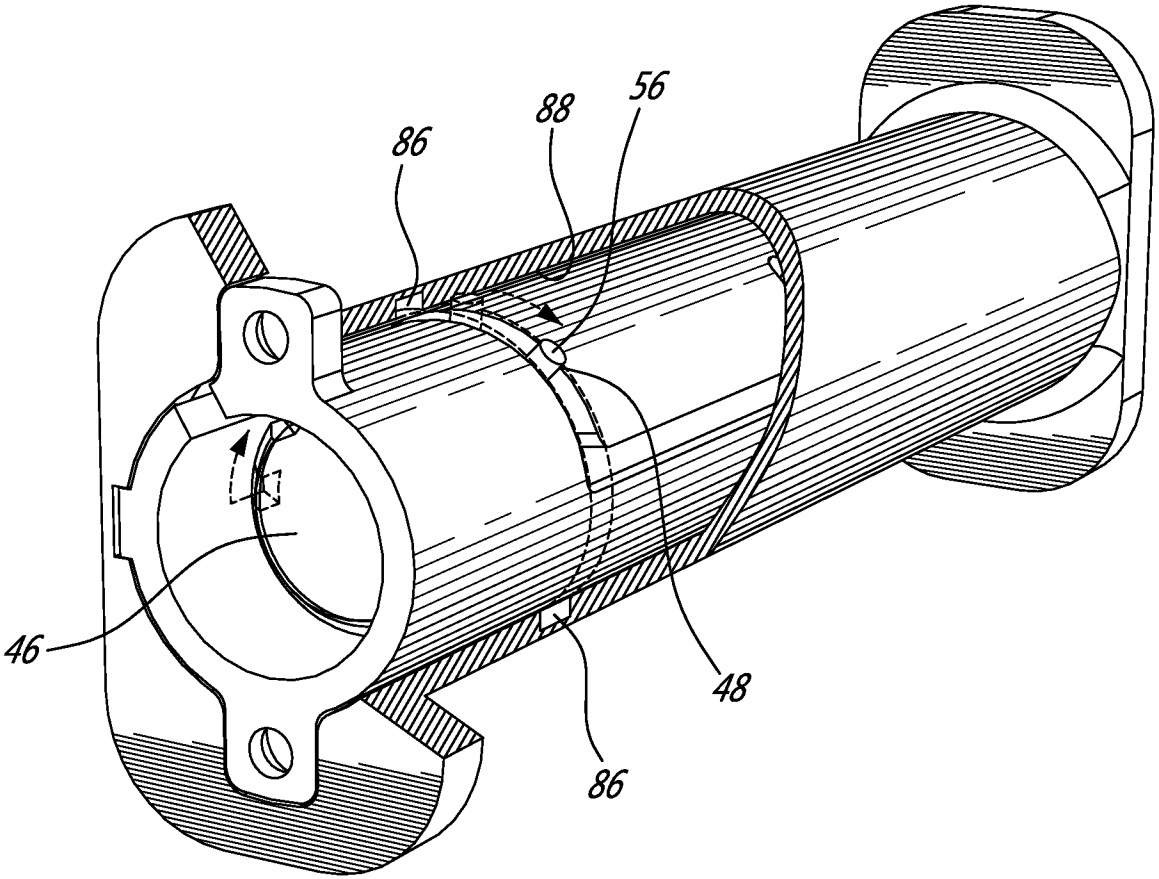
FIG. 4F provides a raised right rear view partially cut away view of an assembled telescoping cable spool in accordance with an illustrative embodiment of the present invention.

Referring now to FIG. 4F in addition to FIG. 3, to complete the assembly the collar 46 is rotated clockwise about 30 degrees. In this regard an annular channel 86 is provided on the inner surface 88 of the housing 20 into which the second end 56 of the guide pin 48 extends and within which the second end 56 of the guide pin 48 can travel radially.

Figure 5A:
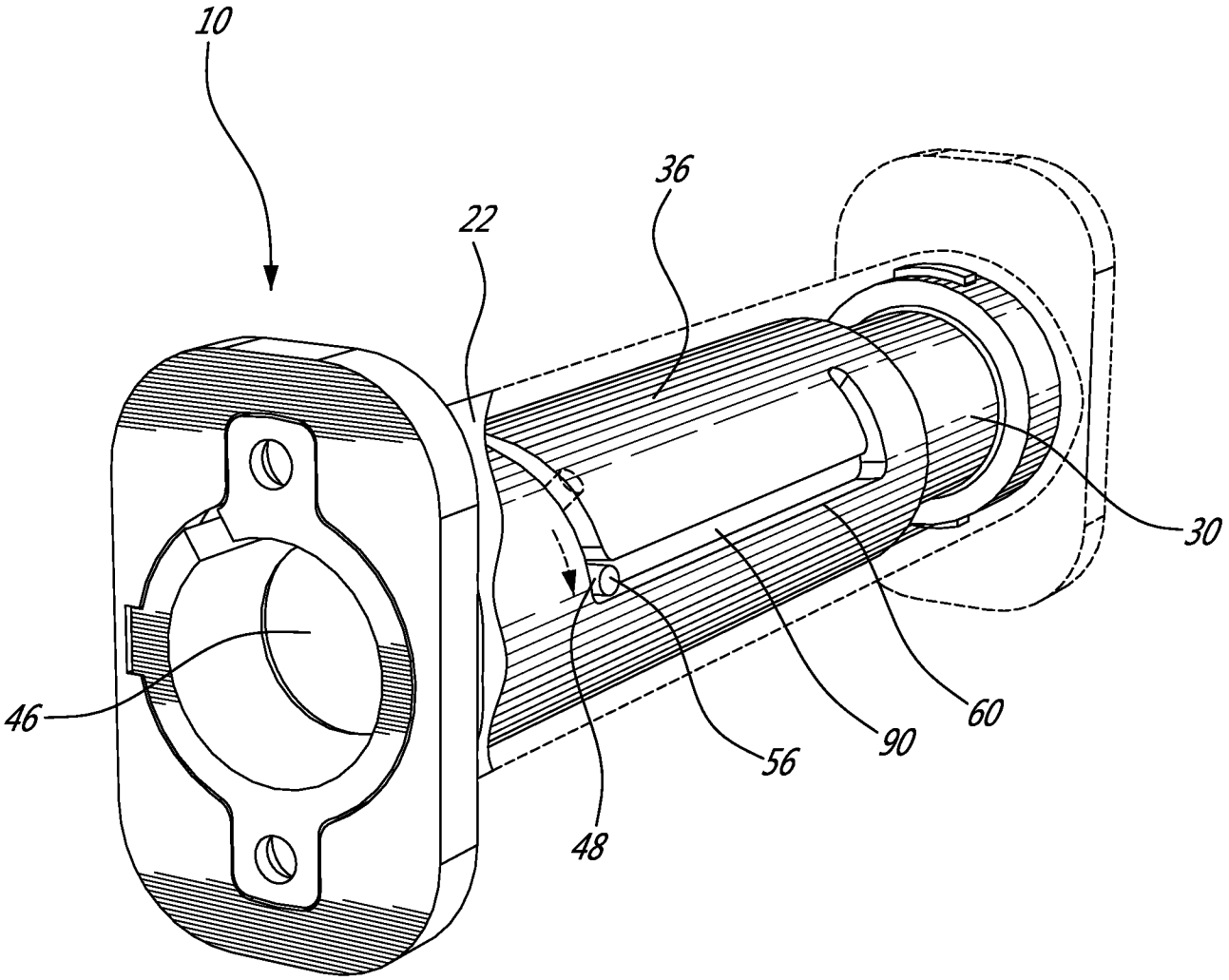
FIG. 5A provides a raised right rear view partially cut away view detailing the operation of a retracted assembled telescoping cable spool in accordance with an illustrative embodiment of the present invention.

Referring to FIG. 5A in addition to FIGS. 3 and 4F, the principle of operation of an assembled spool 10 will now be described. Due to the annular channel 86 in the housing the collar 46 is able to rotate relative to the housing 22 but otherwise must move with the housing 22 longitudinally along the axis of the spool 10. Pressing the actuator 30 imparts a rotational force to the collar 46 via the first end 52 of the guide pin 48 and the first channel 58 in the narrow end 50 of the push button actuator 30. In this regard, the portion of the channel 58 within which the first end 52 of the guide pin 48 moves is at an angle to the longitudinal axis of the spool 10. The angle is chosen such that movement of the push button actuator 30 relative to the housing 22 (and therefore the collar 46) between an unactuated and an actuated position imparts sufficient rotation to the collar 46 such that the second end 56 of the guide pin 48 is brought into alignment with a longitudinal part 90 of the second channel 60 in the fixed part 36.

Figure 5B:
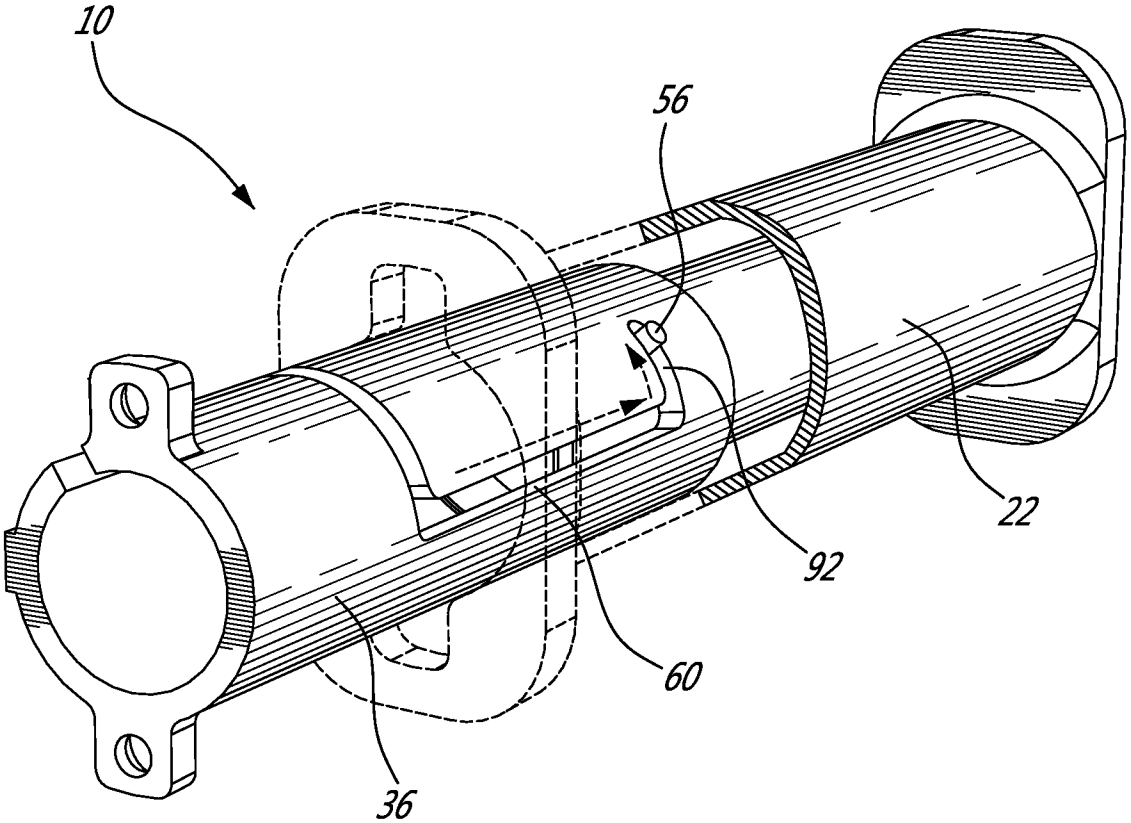
FIG. 5B provides a raised right rear view partially cut away view detailing the operation of an extended assembled telescoping cable spool in accordance with an illustrative embodiment of the present invention.

Referring to FIG. 5B in addition to FIG. 3, the housing 22 is now free to telescope vis-a-vis the fixed part 36 and such that the housing 22 can be extended. Once extended, release of the actuator 30 allows the actuator 30 to return to its non-actuated position relative to the housing 22 via the biasing force of the spring 32. A reverse rotational force is imparted on the collar 46 through the interaction of the first end 52 of the guide pin 48 and the angled section of the first channel 58 and such that the second end 56 of the guide pin 48 travels into an closed end 92 of the second channel 60, thereby locking the housing 22 in its extended position. A person of ordinary skill in the art will now understand that the housing 22 can be replaced in its non-extended position by pushing the actuator 30 while moving the housing 22 into its non-extended position and then releasing the actuator 30.

Figure 6:
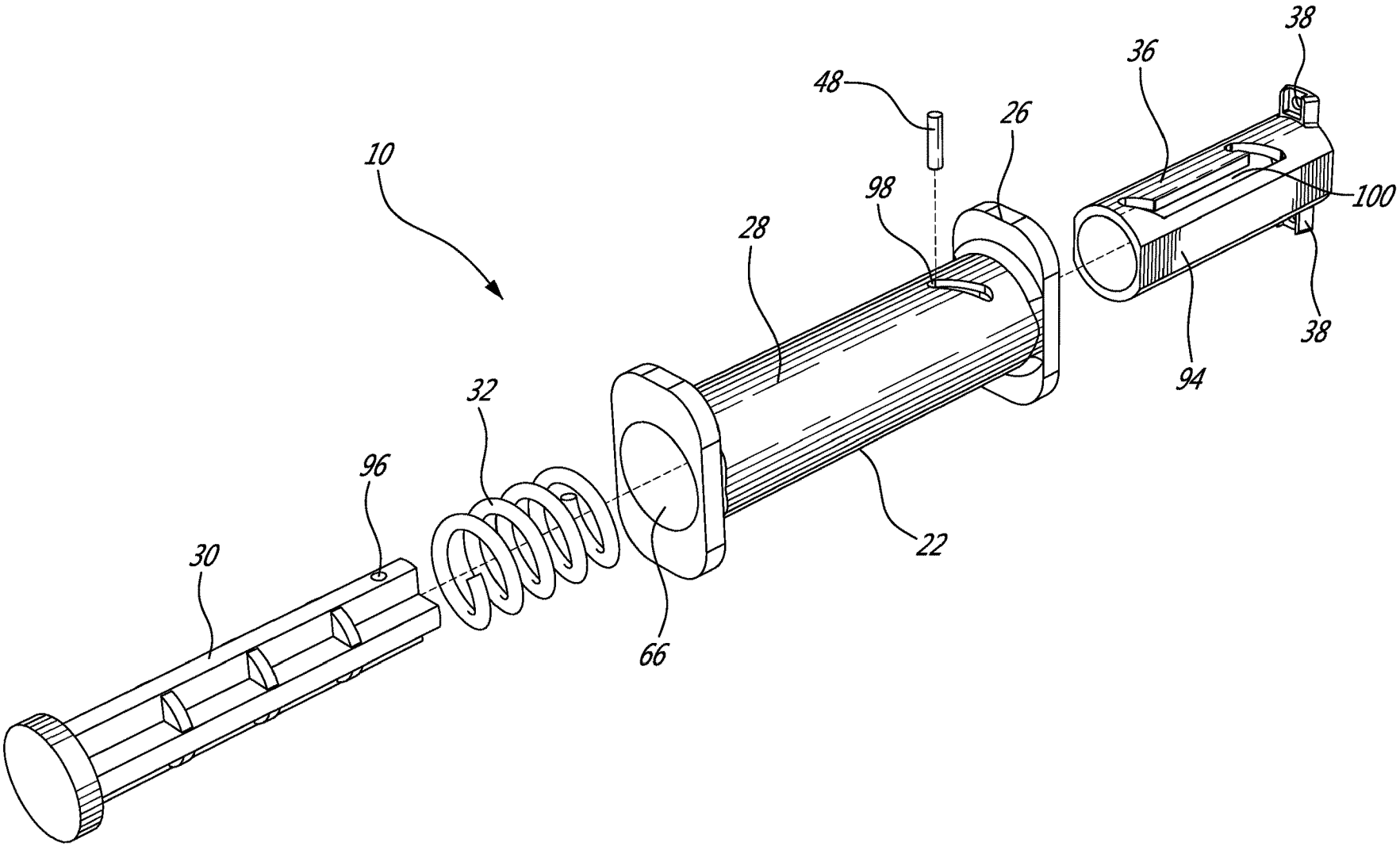
FIG. 6 provides an exploded view of a telescoping cable spool in accordance with an alternative illustrative embodiment of the present invention.

Referring now to FIG. 6, in an alternative embodiment the spool 10 is comprised of a housing 22 comprising a hollow cylindrical cable support 28, an actuator 30, a spring 32 and a fixed part 36. As will be discussed in more detail below a guide pin 48, manufactured from steel or the like, is also provided.

Still referring to FIG. 6, in order to assemble the alternative embodiment of the spool 10 prior to installation of the spool 10 onto a surface 40, the spring 32 is placed over the push button actuator 30 and inserted into the opening 66 until the spring is compressed between the actuator 30 and an annular partial collar 72 which is positioned within the cylindrical cable support 28. Alternatively the spring 32 can simply be inserted into the opening 66 in the retaining cable flange 24. The fixed part 36 is then inserted into the housing 22 until the attachment flanges 38 are received in corresponding cut-outs (not shown) in the rearward cable retaining flange 26. In this regard, the inner surface (not shown) of the cylindrical cable support 28 matches a pair of opposed flat surfaces 94 such that the fixed part 36 is oriented correctly vis-a-vis the housing 22. A guide pin receiving bore 96 in the actuator 30 is aligned with a guide slot 98 in the cylindrical cable support 28 and the guide pin 48 inserted into the bore 96 and via the guide channel 100 in the fixed part 36.

Figure 7A:
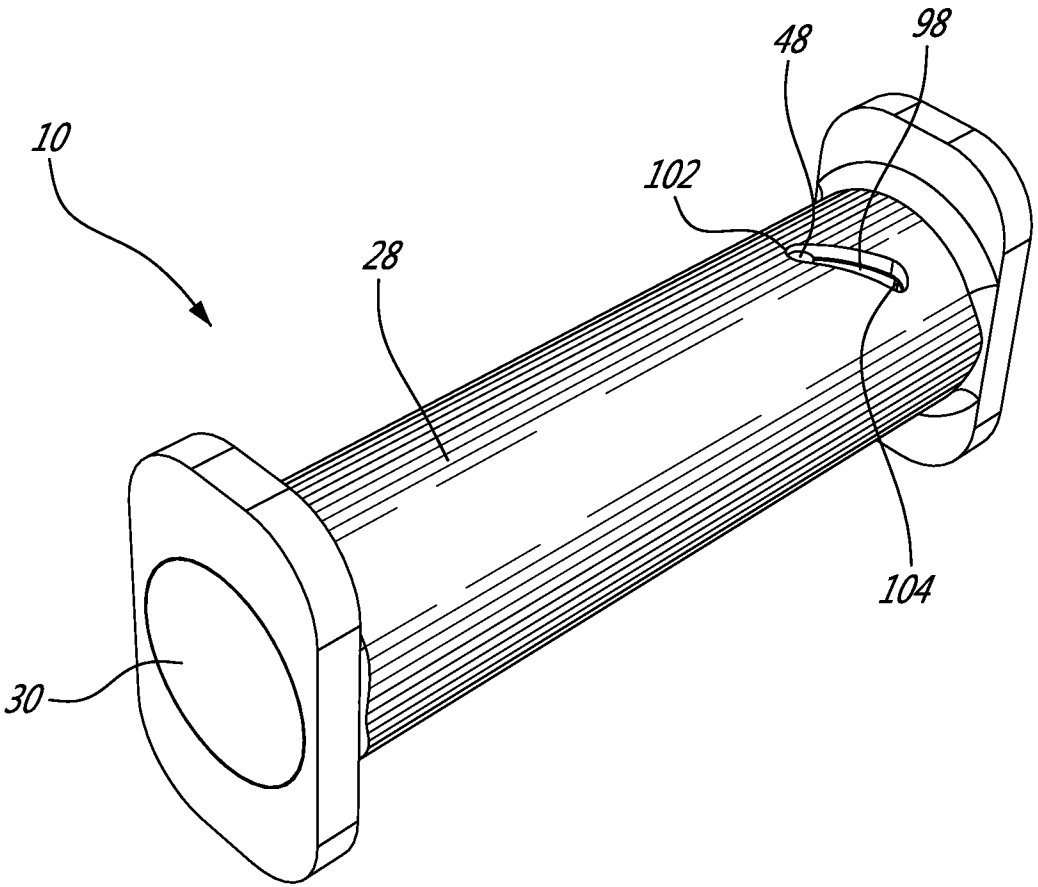
FIG. 7A provides a raised right front perspective view of a telescoping cable spool in a retracted position and in accordance with an alternative illustrative embodiment of the present invention.
Figure 7B:
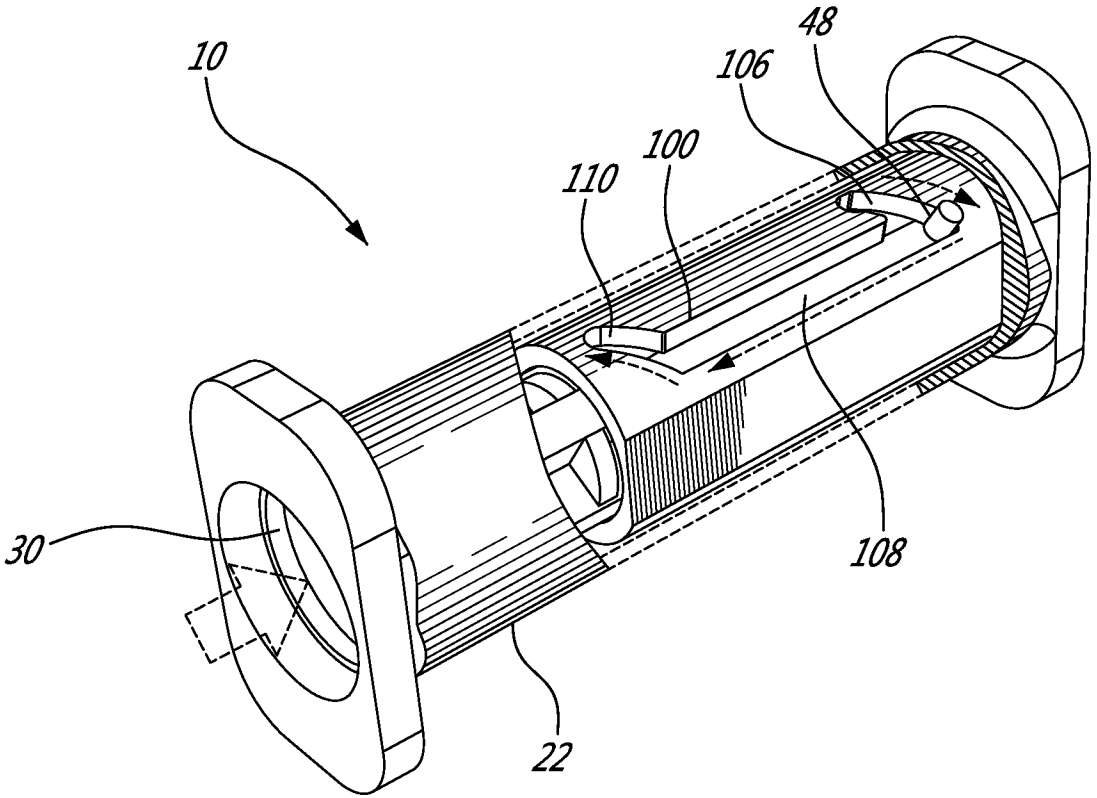
FIG. 7B provides a raised right front partially cut away view of a telescoping cable spool in an unlocked position and in accordance with an alternative illustrative embodiment of the present invention.
Figure 7C:
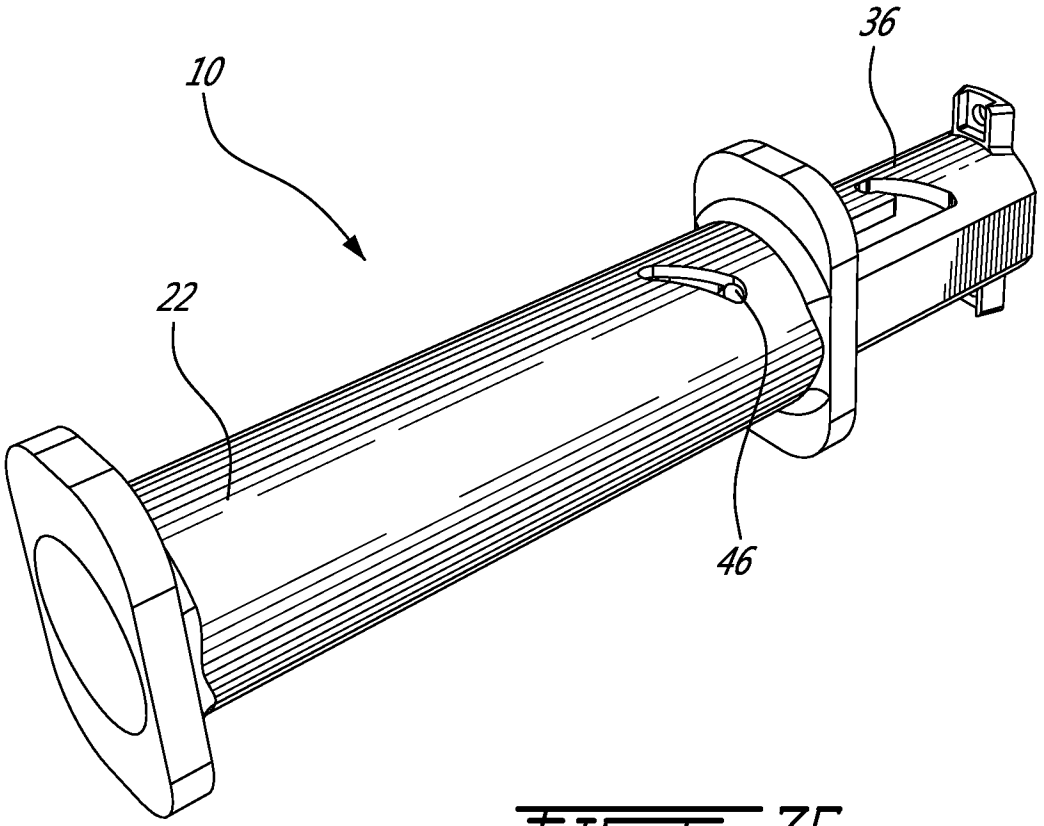
FIG. 7C provides a raised right front perspective view of a telescoping cable spool in an unlocked extended position and in accordance with an alternative illustrative embodiment of the present invention.
Figure 7D:
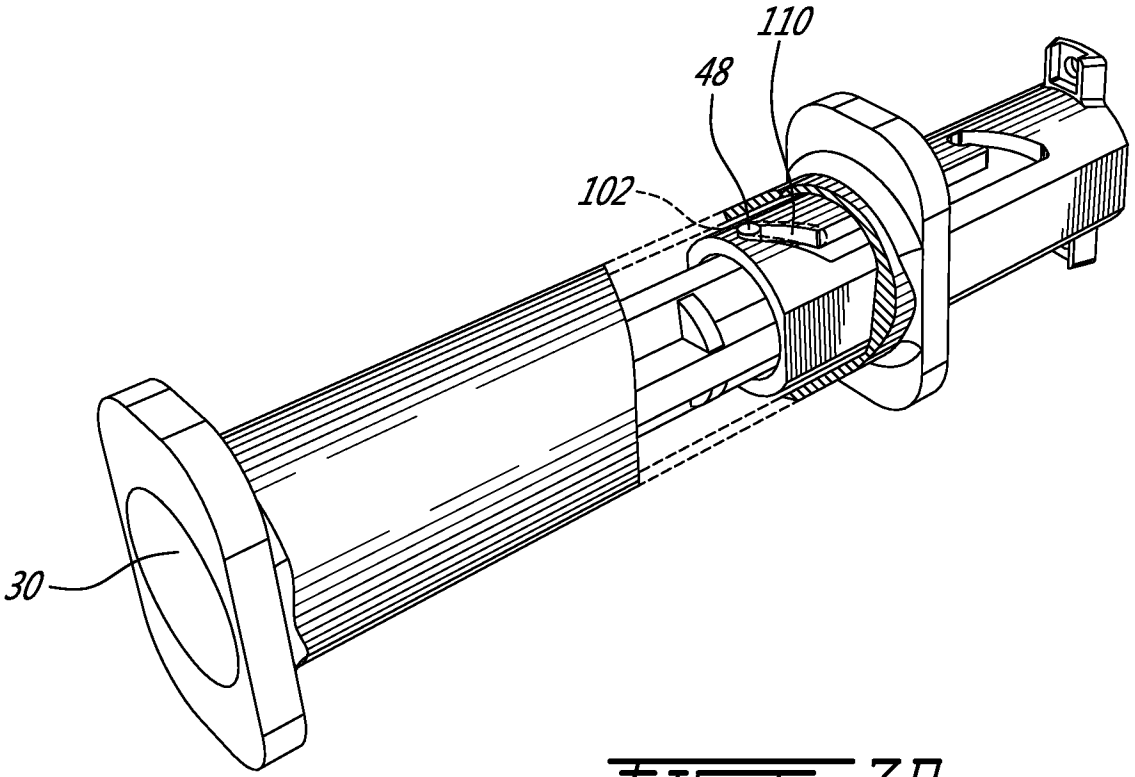
FIG. 7D provides a raised right front partially cut away view of a telescoping cable spool in a locked extended position and in accordance with an alternative illustrative embodiment of the present invention.

Referring to FIG. 7A, in an un-actuated state the guide pin 48 is held against a first end 102 of the guide slot 98 in the cylindrical cable support 28 by the spring 32. Referring to FIG. 7B in addition to FIG. 7A, by pressing the actuator 30 the guide pin 48 is moved within the guide slot 98 towards a second end 104 thereof while imparting a rotation to the actuator 30. The guide pin 49 also travels within a first angled guide channel part 106 of the guide channel 100 until it is aligned with a longitudinal guide channel part 108. With reference to FIG. 7C in addition to FIG. 7B, at this point the housing 22 can be telescoped relative to the fixed part 36 until the guide pin 48 reaches a second angled guide channel part 110. Subsequent release of the actuator 30 allows the actuator 30 to move relative to the housing 22 via the biasing force of the spring 32. The guide pin 48 moves into the second angled guide channel part 110, thereby imparting a rotation to the actuator, and while the guide pin 48 simultaneously returns to the first end 102 of the guide slot 98, thereby locking the housing 22 in its extended position. A person of ordinary skill in the art will now understand that the housing 22 can be replaced in its non-extended position by pushing the actuator 30 while moving the housing 22 into its non-extended position and then releasing the actuator 30.

Figure 8A:
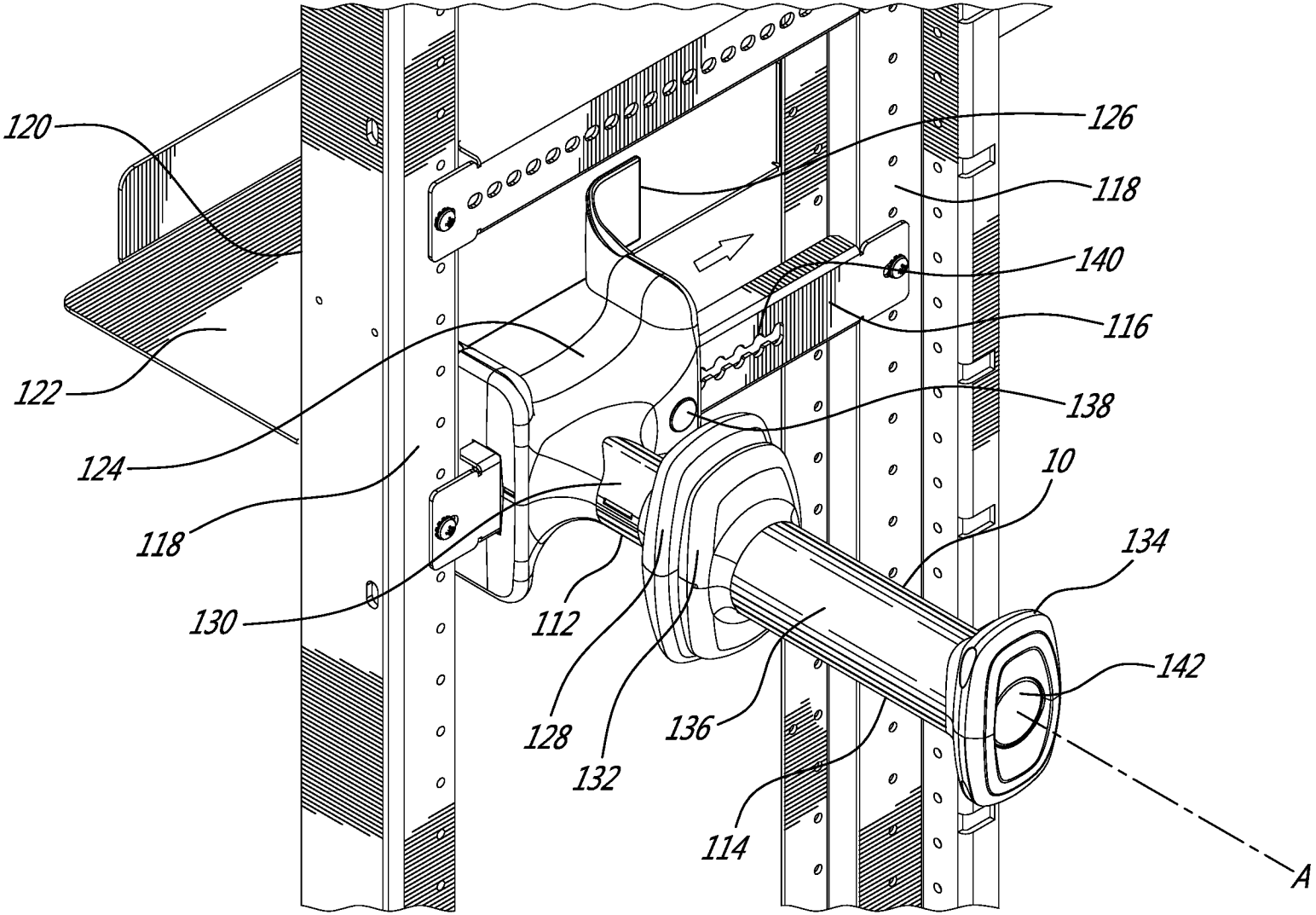
FIG. 8A provides a raised left front perspective view of a telescoping cable spool mounted to a networking equipment and in accordance with a second alternative illustrative embodiment of the present invention.

Referring now to FIG. 8A, in an alternative embodiment, the cable spool 10 is separated into a static cable spool 112 and an extendable cable spool 114. The static cable spool 112 is illustratively slideably mounted to an elongate rail 116 which is in turn secured horizontally between the vertical supports 118 of a cross connect cabinet 120 or the like. A tray 122 is illustratively provided behind the vertical supports 118 for receiving one or more optical cables (not shown) or the like. Additionally, a cable guide 124 is provided between the static cable spool 112 and the tray 122 via which the one or more cables may transit between the static cable spool 112 and the tray 122. A vertical guide 126 is provided on either side of the cable guide 124 to ensure a smooth transition between the tray 122 and the static cable spool 112. The static cable spool 112 further comprises a cable retaining flange 128 separated from the aperture 124 by a cylindrical cable support 130. Similarly, the extendable cable spool 114 comprises an inner and outer pair of cable retaining flanges, respectively 132, 134, separated from one another by a cylindrical cable support 136.

Still referring to FIG. 8A, as will be discussed in more detail below, a release button 138 is provided which disengages a rail locking mechanism (not shown) which comprises inter alia a serrated cut-out 140 in the elongate rail 116. Releasing the rail locking mechanism allows the assembly of the static cable spool 112 to be slid along the elongate rail 116 and such that the assembly comprising the static cable spool 112 and the extendable cable spool 114 may be moved horizontally in a direction at right angles to the spool axis A of the cable spool 10.

Figure 8B:
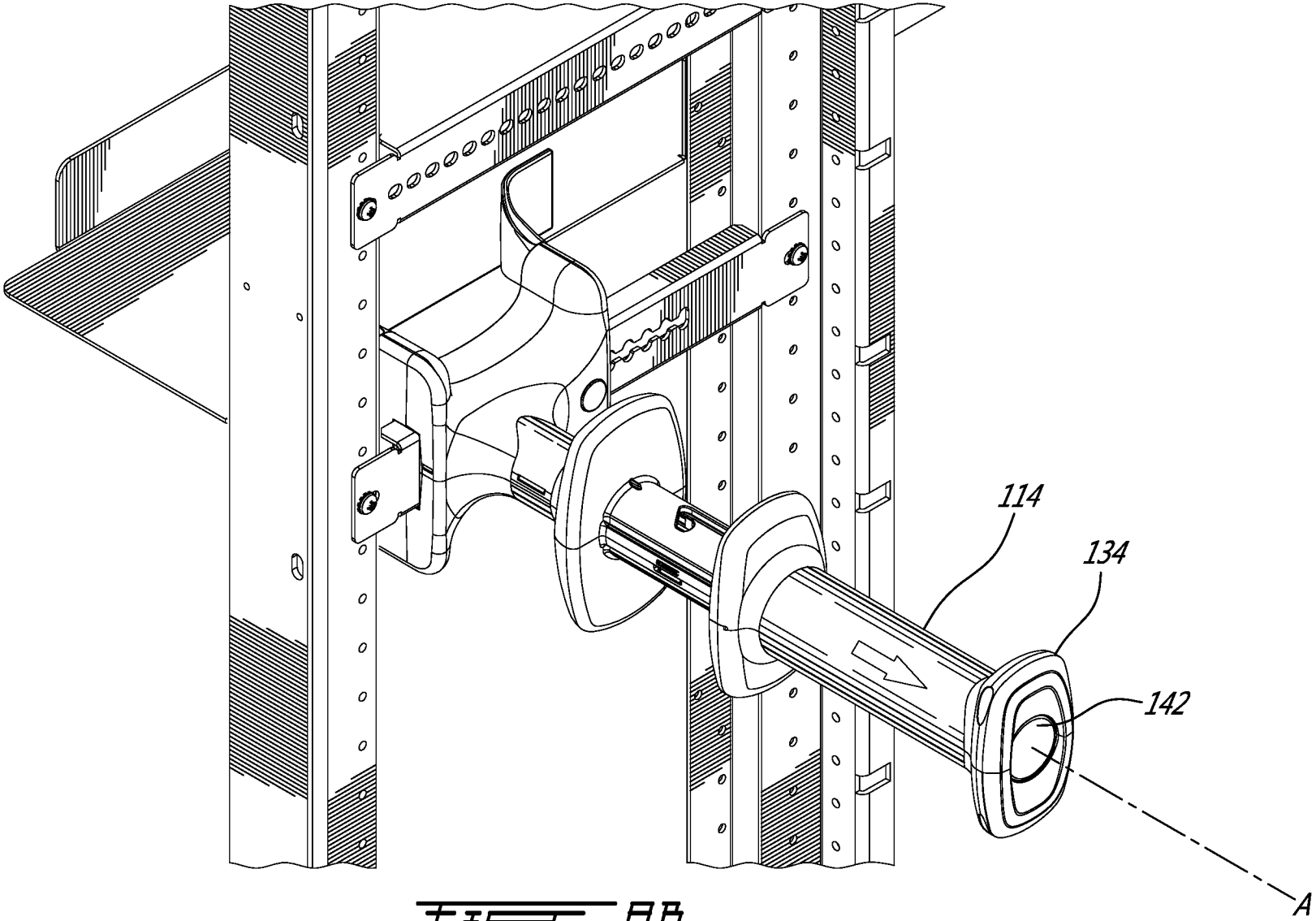
FIG. 8B provides a raised left front perspective view of the telescoping cable spool of FIG. 8A with a cable spool extended.

Referring now to FIG. 8B in addition to FIG. 8A, as will be discussed in more detail below, the extendable cable spool 114 is secured in place by a mechanism (not shown) which can be released by pressing a push button actuator 142 while for example pulling on the outer cable flange 134.

Figure 8C:
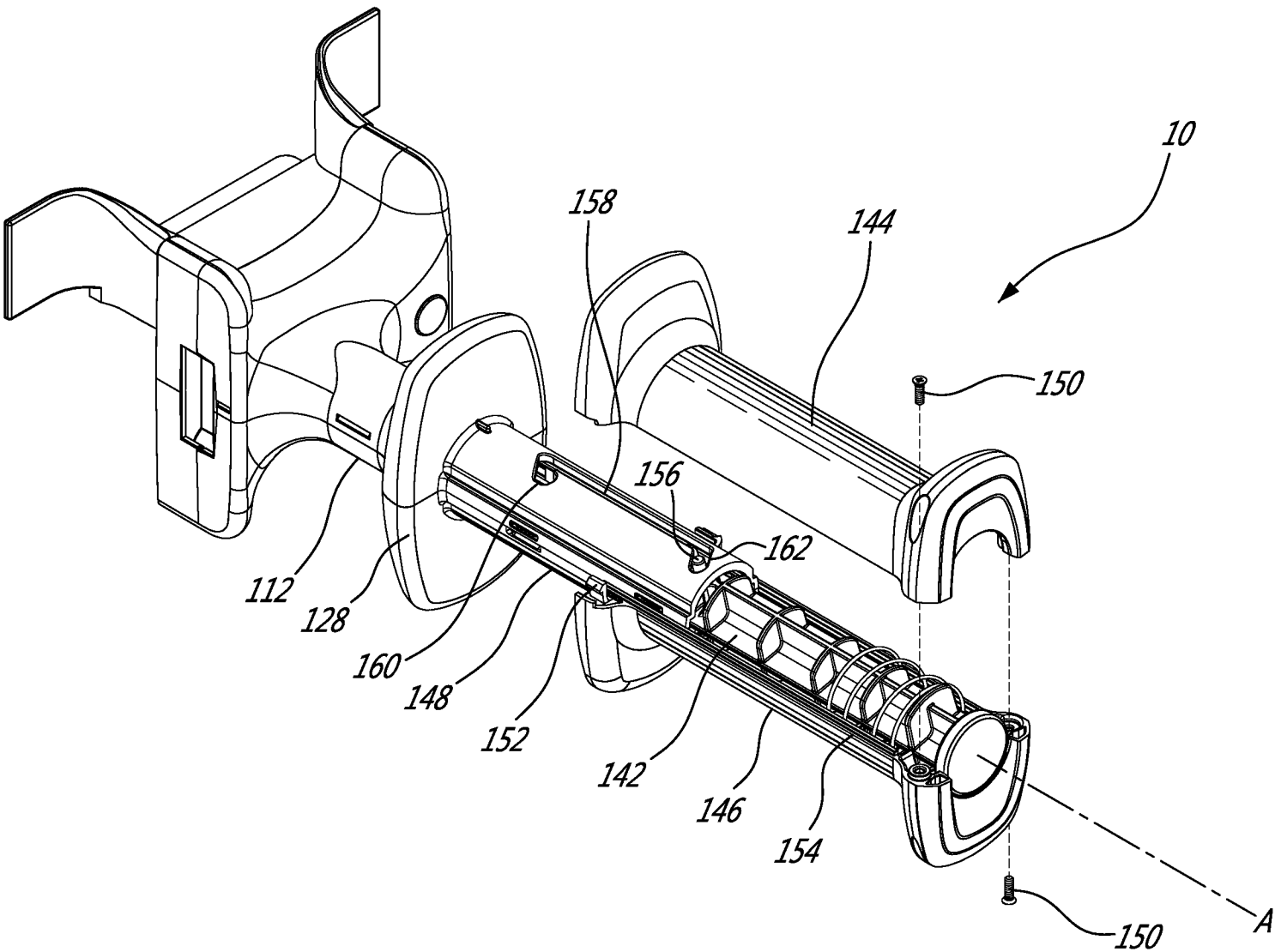
FIG. 8C provides a raised left front partially exploded perspective view of the telescoping cable spool of FIG. 8A.

Referring now to FIG. 8C, the extendable cable spool 114 is illustratively comprised of upper and lower opposed halves, respectively 144, 146. The halves 144, 146 are secured together about the push button actuator 142 and a cylindrical fixed part 148 extending from the cable retaining flange 128 of the static cable spool 112 and along which the assembled halves 144, 146 may slide. In this regard, the halves 144, 146 are secured together to form the extendable cable spool 114 via fasteners illustratively comprising selftapping screws 150 and interlocking flexible tabs 152 or the like. A spring 154 is provided to bias the pushbutton actuator 142 outwards along the axis A of the cable spool 10. The pushbutton actuator 142 comprises a pair of guide pins 156 that move within respective slots 158 in the cylindrical fixed part 148 thereby limiting the travel of the pushbutton actuator 142 relative to the cylindrical fixed part 148 between a retracted position and an extended position. In this regard, each slot 158 comprises a rearward guide pin receiving angled slot 160 and a forward guide pin receiving angled slot 162 at either end thereof. As will be discussed below, each guide pin 156 rests in one of the guide pin receiving angle slots 160, 162 when the extendable cable spool 114 is in one of the retracted position or extended position.

Referring to 8D in addition to FIG. 8C, the end of each guide pin 156 engages respective ones of a pair of elongate recesses 164 positioned on an inner surface 166 of a respective one of the upper and lower opposed halves 144, 146. The pair of recesses 164 interlink the guide pins 156 with their respective opposed halves 144, 146 such that when assembled the pushbutton actuator 142 and the extendable cable spool 114 move together when the extendable cable spool 114 is moved between the retracted position and the extended position.

Figure 9A:
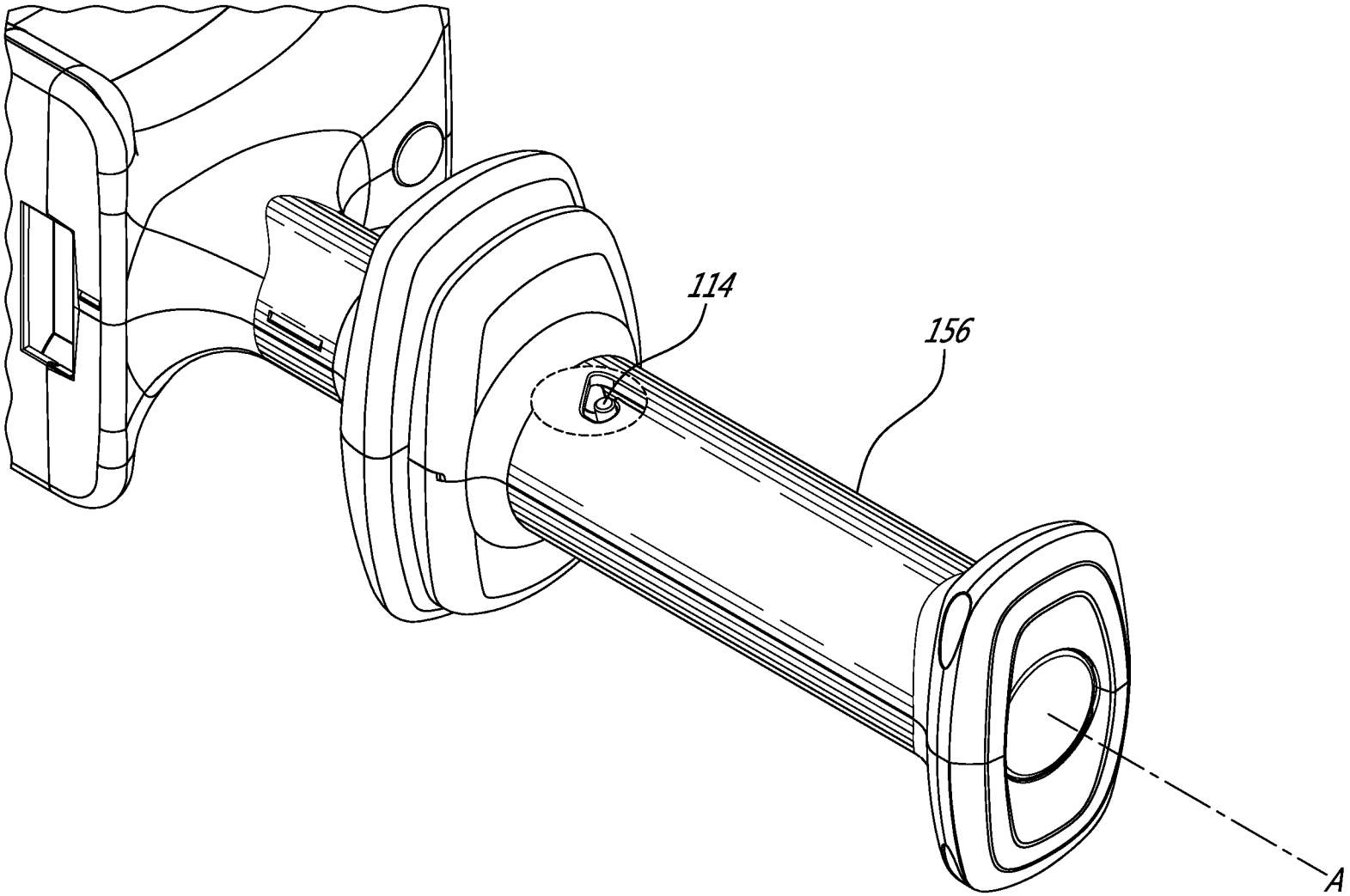
FIG. 9A provides a first detail cutaway view of the telescoping cable spool of FIG. 8A in a retracted position.

Referring now to FIG. 9A, in a first retracted position of the extendable cable spool 114, as discussed above, when in the retracted position the guide pins 156 are engaged in respective ones of the rearward guide pin receiving angles 160. As will now be understood by a person of ordinary skill in the art, and with additional reference to FIG. 8C, the spring 154 biases the pushbutton actuator 142 relative to the cable spool 114 and such that the end of each guide pin 156 is biased normally towards a front of their respective elongate recesses 164. Moving the pushbutton actuator 142 against the bias of the spring 154 introduces a small rotational movement to the pushbutton actuator 142 relative to the cable spool 114 as the end of the guide pin 156 travels along the elongate recess 164 which in turn moves the guide pin 156 out of the rearward guide pin receiving angled slot 160 and into the elongate slot 158 such that the cable spool 114 can be extended. On release of the pushbutton actuator 142 when the cable spool 114 is in the retracted position, the biasing ensures that the ends of the guide pins 156 move forward along the recess 164 and such that guide pins 156 are moved into and held securely in their respective rearward angled slot 160. A similar effect is achieved when the cable spool 114 is in the extended position, and the guide pins 156 are moved under bias of the spring 154 into their respective forward guide pin receiving angled slot 162.

Figure 8D:
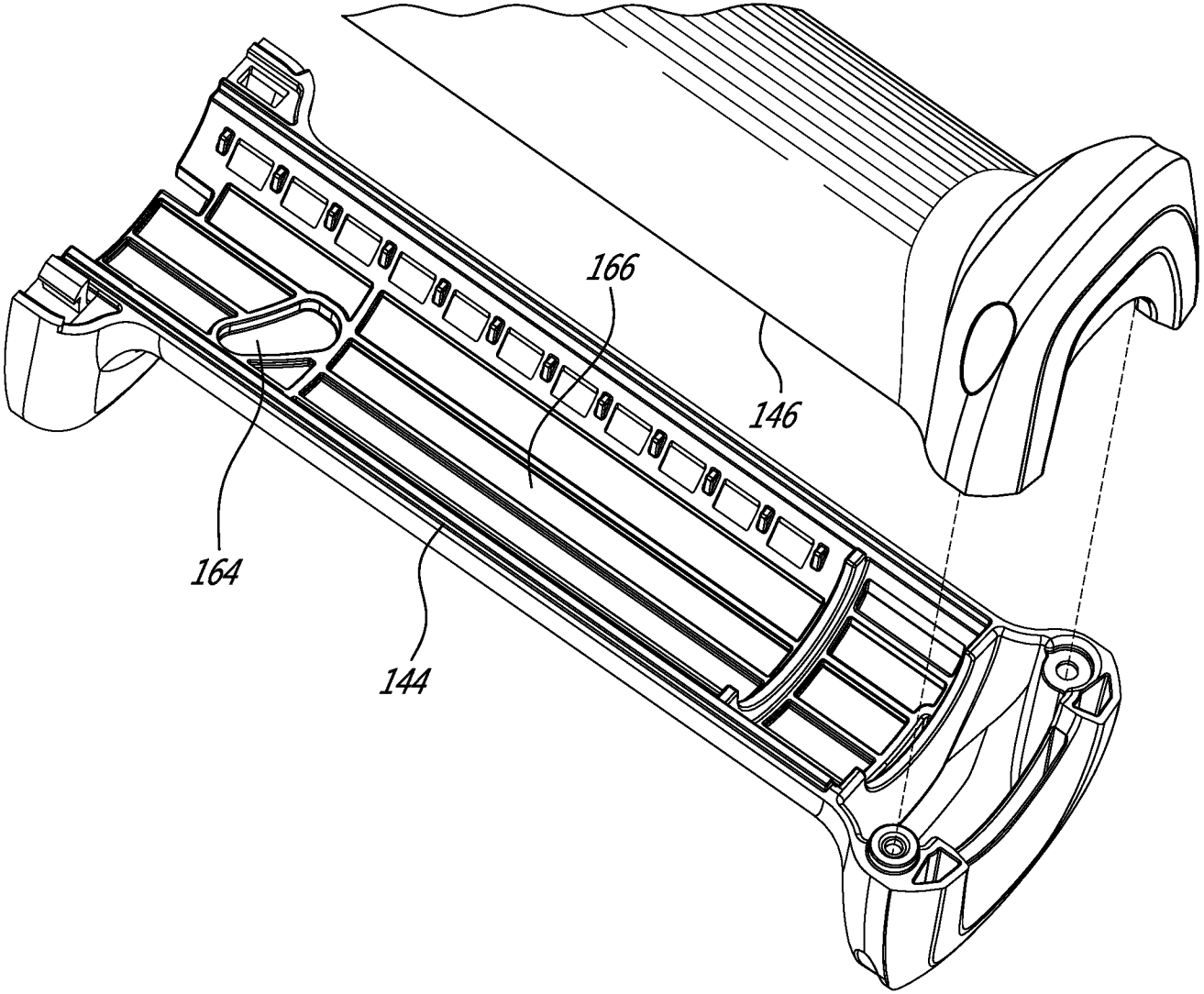
FIG. 8D provides a detailed perspective view an inner surface of the extendable cable spool of FIG. 8A.
Figure 9B:
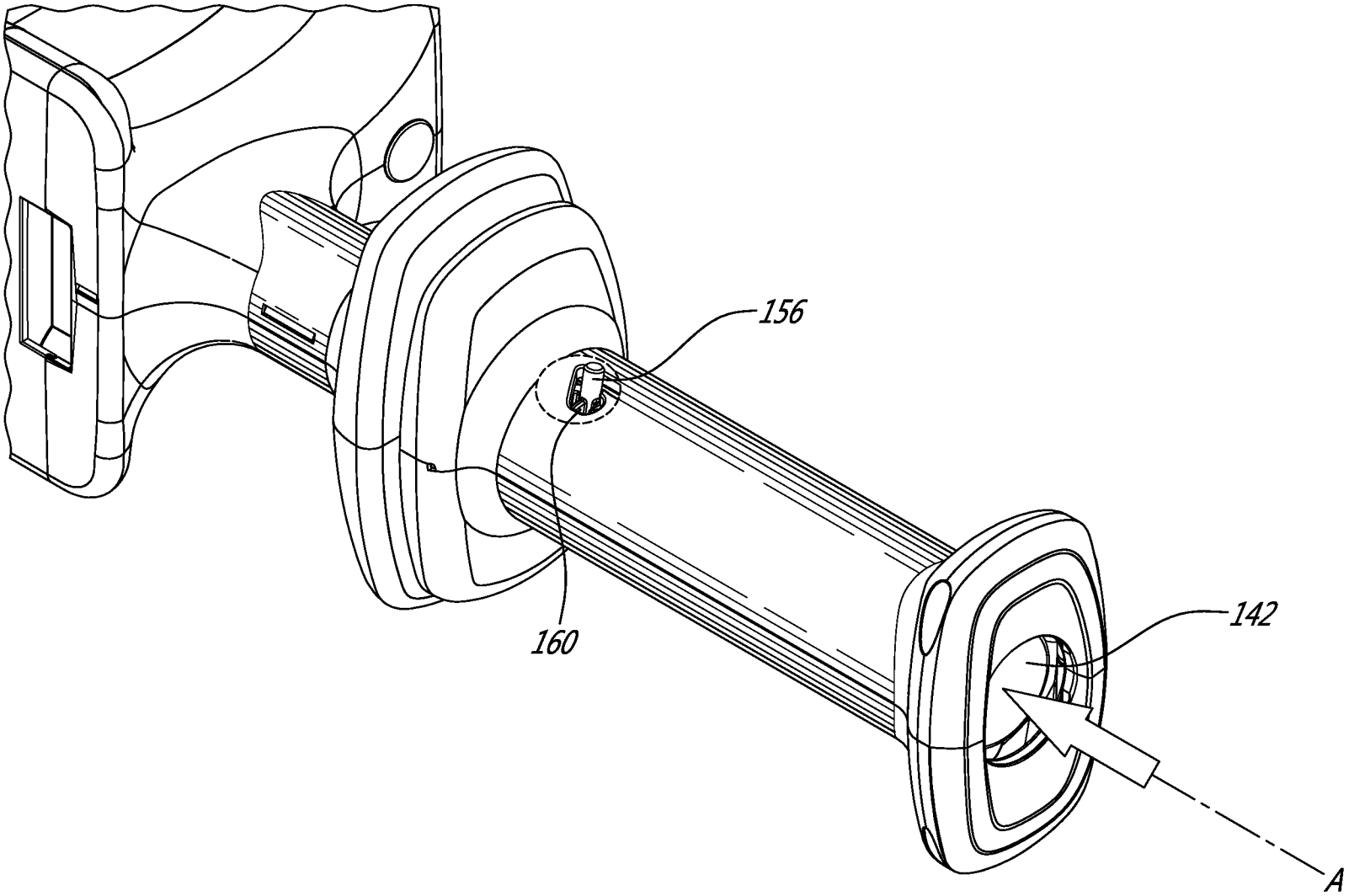
FIG. 9B provides a second detail cutaway view of the telescoping cable spool of FIG. 8A in an intermediate position.
Figure 16:
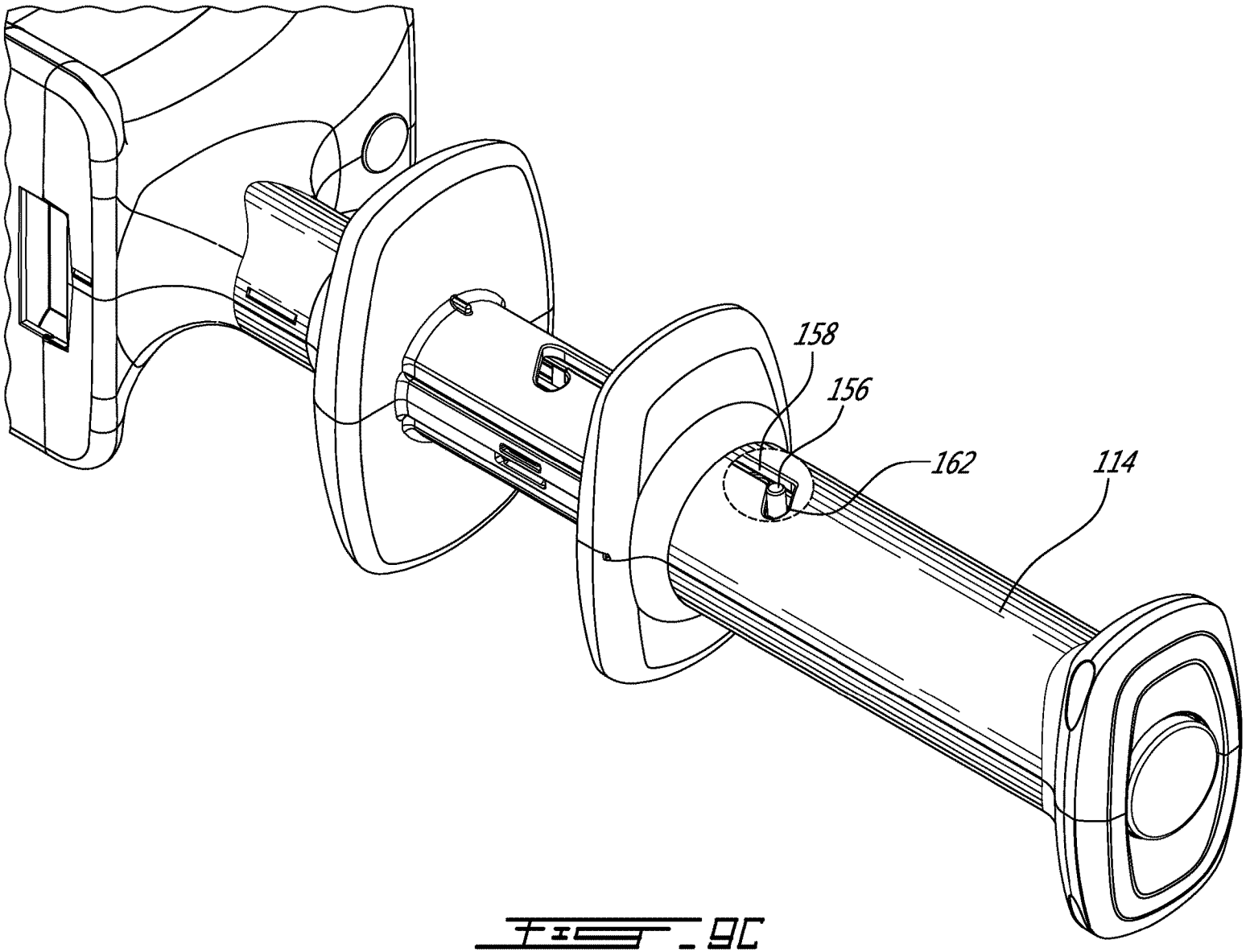

Referring to FIG. 9B, and in light of the discussion above, the guide pins 156 are moved out of their respective rearward guide pin receiving angles 160 by pushing the pushbutton actuator 142 against the bias of the spring 154 (reference 154 in FIG. 8D). In this manner, the guide pin 156 is moved out of the rearward guide pin receiving angled slot 160 and into the slot 158.

Referring now to FIG. 9C, once the guide pin has been actuated into the slot 158 the extendable cable spool 114 can be moved into the extended position where the guide pin 156 comes to rest in the forward guide pin receiving angled slot 162.

Figure 10A:
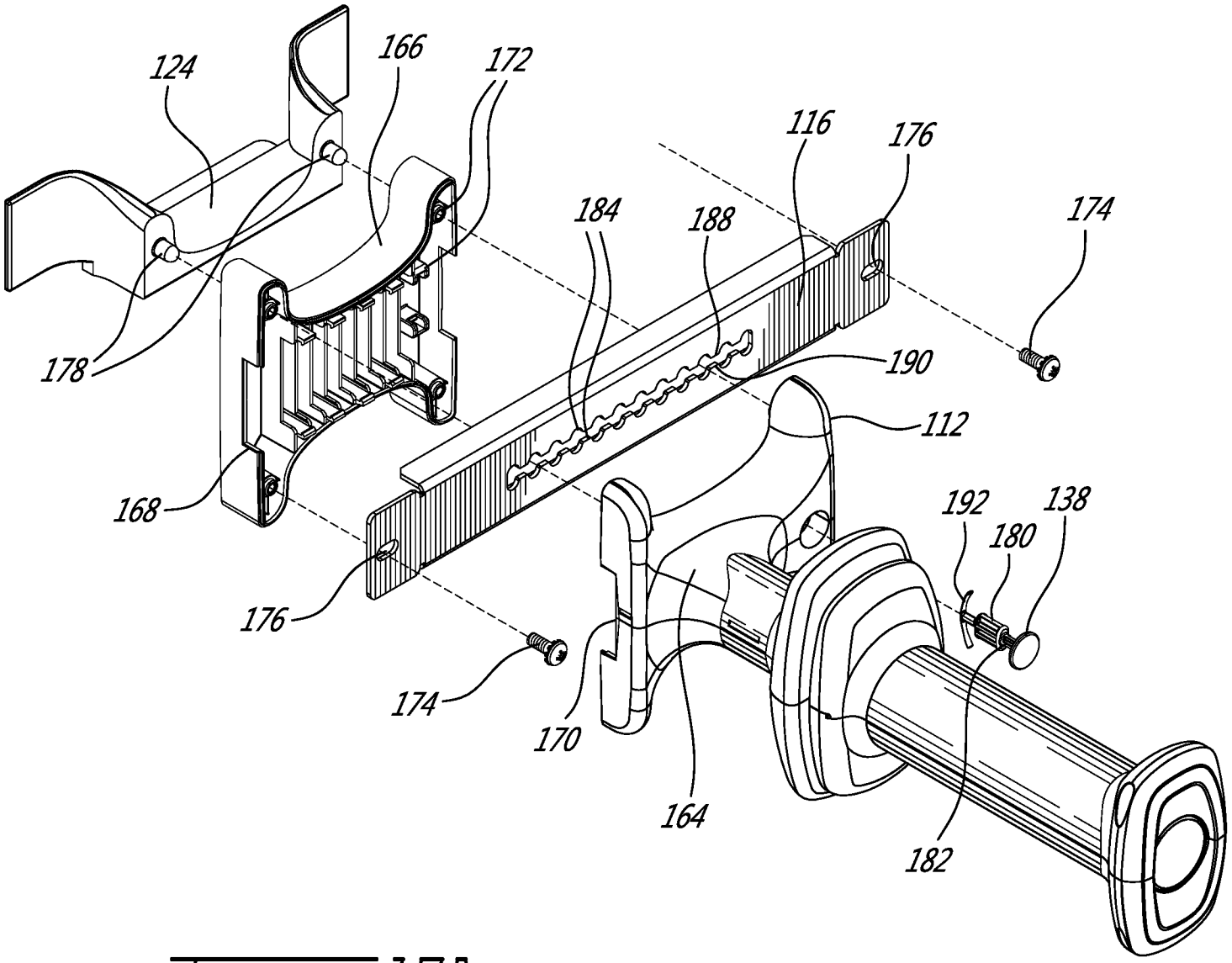
FIG. 10A provides a partially exploded view of the telescoping cable spool of FIG. 8A detailing the attachment to the networking equipment.

Referring now to FIG. 10A, static cable spool 112 comprises a front cable spool part 164 which is snap fit to a rear cable spool part 166 about the elongate rail 116 which fits within an aperture formed by cut outs 168, 170 and such that the horizontal rail 116 slides therein. The rear cable spool part 166 comprises flexible tabs 172 which engage with corresponding features on the front cable spool part 164 to secure the two pieces together. Screws (not shown) are also provided. The elongate rail 116 is securable to the vertical supports 118 of a cross connect cabinet 120 by a pair of bolts 174 which are inserted through respective ones of a pair of cut 176 outs in the elongate rail 116. Similarly, the cable guide 124 is secured to the rear cable spool part 166 by a pair of bosses 178 which engage with respective indentations (not shown) on a rearward side of the rear cable spool part 166.

Figure 10B:
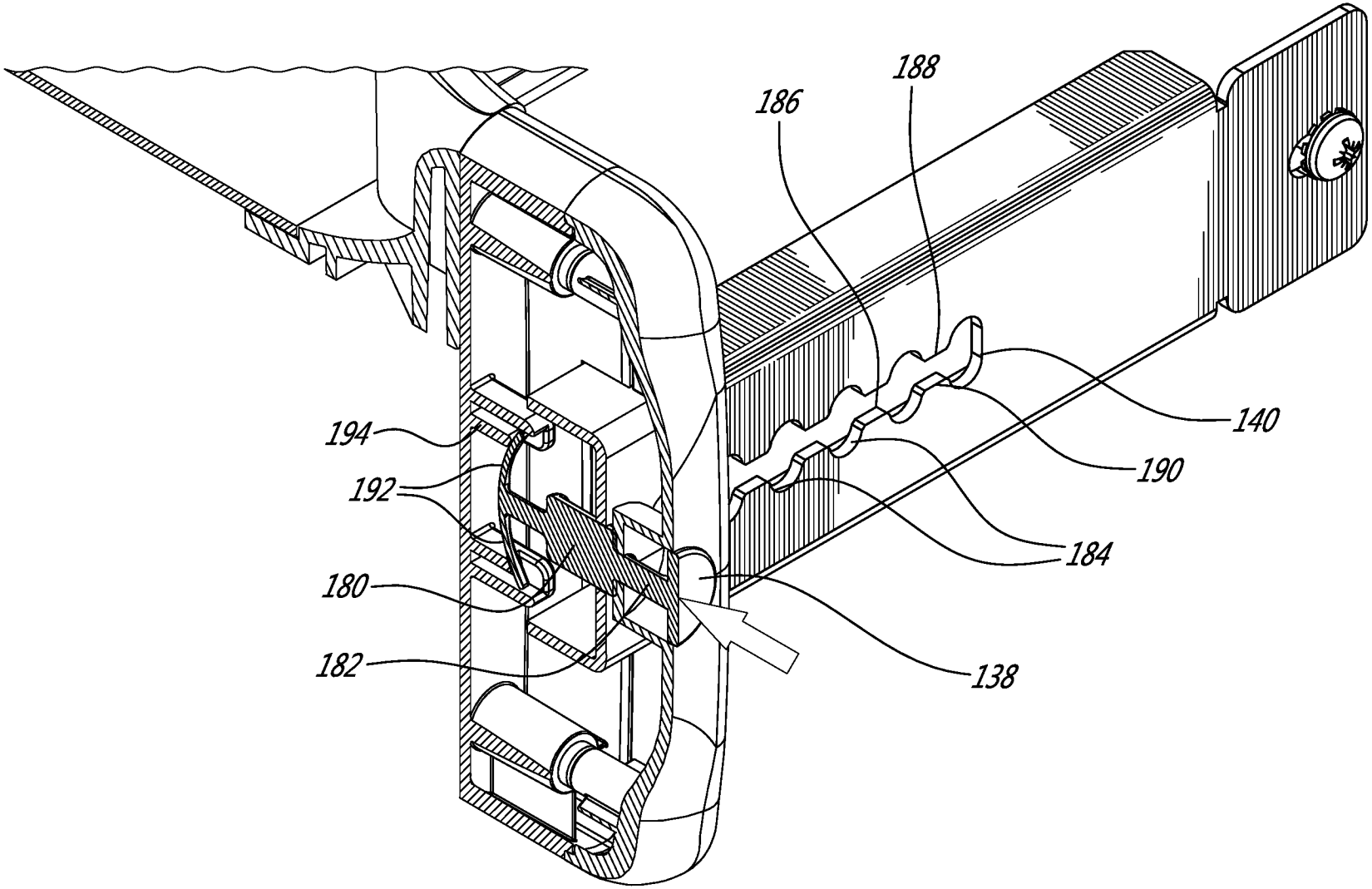
FIG. 10B provides a sectional view along XB-XB in FIG. 8A.

Referring now to FIG. 10B in addition to FIG. 10A, as discussed above a release button 138 is provided which releases a mechanism such that the cable spool 10 may slide horizontally along the elongate rail 116. The mechanism comprises a stop 180 which is connected to the release button 138 by a relative narrow collar 182. The serrated cut-out 140 defines plurality of stop receiving spaces 184 arranged side by side in a line along said elongate rail 116. Each stop receiving space 184 is separated from adjacent stop receiving spaces 184 by a relatively narrow gap 186 which are defined by pairs of opposed teeth 188, 190. The mechanism further comprises a pair of flexible arms 192 which are held within recesses 194 in the rear cable spool part 166 and which serve to bias the stop 180 and the release button 138 against an actuating force. Pressing the release button 138 brings the collar 182 into alignment with the gaps 186. As the dimensions of the collar 182 are such that the collar 182 may pass freely through each gap 186, the cable spool 10 is free to slide along the elongate rail 116. On release of the release button 138 the flexible arms 188 bias the stop 180 towards the stop receiving spaces 184 and such the stop 180 will move into an aligned one of the stop receiving spaces 184, thereby preventing the cable spool 10 from sliding along the elongate rail 116.

Although the present invention has been described hereinabove by way of specific embodiments thereof, it can be modified, without departing from the spirit and nature of the subject invention as defined in the appended claims.

The invention claimed is:

1. A telescoping cable spool for attaching to a networking equipment and supporting a plurality of fiber optic cables, the spool comprising:

a fixed part for attachment to a surface adjacent the networking equipment;

a spool housing comprising a pair of cable retaining flanges interconnected by a hollow cable support dimensioned to fit in a telescoping arrangement over said fixed part, said spool housing moveable relative to said fixed part between a first retracted position and a second extended position.

2. The telescoping cable spool of claim 1, further comprising a locking mechanism for releasably retaining said spool housing in said first retracted position.

3. The telescoping cable spool of claim 2, further comprising an actuator for releasing said locking mechanism.

4. The telescoping cable spool of claim 1, wherein said fixed part is elongate and cylindrical.

5. The telescoping cable spool of claim 3, wherein said fixed part is hollow and said actuator comprises a member dimensioned to fit slideably within said fixed part for movement between a locked position and an actuated position and a spring for biasing said actuator into said locked position.

6. The telescoping cable spool of claim 1, wherein said fixed part comprises a base for attachment to the surface adjacent the networking equipment.

7. A cable spool comprising:

a fixed part comprising a base configured for attachment to a surface;

a moveable part comprising a cable supporting part bordered at each end by a cable retaining part;

wherein the moveable part is arranged in a telescoping arrangement with the fixed part; and wherein the moveable part is configured for movement relative to the fixed part between a first retracted position and a second extended position.

8. The cable spool of claim 7, wherein the fixed part and the moveable part are arranged along concentric axes.

9. The cable spool of claim 7, wherein the cable retaining part comprises a cable retaining flange.

10. The cable spool of claim 9, wherein a transition between the cable supporting part and each cable retaining flange is smooth.

11. The cable spool of claim 7, wherein the cable supporting part is hollow and dimensioned to fit over the fixed part.

12. The cable spool of claim 7, further comprising a locking mechanism for securing the moveable part a selected one of the first retracted position and the second extended position.

13. The cable spool of claim 7, wherein the cable supporting part is cylindrical.

14. A telescoping cable spool, the spool comprising:

a fixed part;

a spool housing comprising a pair of raised cable retaining parts interconnected by a cable support;

wherein the fixed part is configured for attachment to a vertical surface;

wherein the spool housing is dimensioned to fit in a telescoping arrangement over the fixed part;

wherein the spool housing is configured for movement relative to the fixed part between a first retracted position and a second extended position; and wherein the spool housing is elongate and comprised of two elongate halves and further wherein when assembled the two like halves define a hollow space dimensioned to fit over the fixed part.

15. The telescoping cable spool of claim 14, wherein the cable support is tubular.

16. The telescoping cable spool of claim 14, wherein the cable support retaining part comprises a cable retaining flange.

17. The telescoping cable spool of claim 16, wherein the cable support and the cable retaining flanges are concentric.

18. The telescoping cable spool of claim 16, wherein a transition between the cable support and each cable retaining flange is smooth.

* * * * *